United States Patent [19]

Fujita et al.

[11] 4,245,028

[45] Jan. 13, 1981

[54] PHOTOGRAPHIC LIGHT-SENSITIVE SHEET FOR THE COLOR DIFFUSION TRANSFER PROCESS

[75] Inventors: Shinsaku Fujita; Tooru Harada; Katsusuke Endo, all of Minami-ashigara, Japan

[73] Assignee: Fuji Photo Film Co., Ltd., Minami-ashigara, Japan

[21] Appl. No.: 13,998

[22] Filed: Feb. 21, 1979

[30] Foreign Application Priority Data

Feb. 20, 1978 [JP] Japan ..... 53-18372

[51] Int. Cl.[3] ..... G03C 1/40; G03C 1/10

[52] U.S. Cl. ..... 430/223; 430/225; 430/226; 430/562

[58] Field of Search ..... 96/77, 29 D, 99, 73; 430/223, 562, 225, 226

[56] References Cited

U.S. PATENT DOCUMENTS

| | | | |
|---|---|---|---|
| 3,443,940 | 5/1969 | Bloom et al. | 96/77 |
| 4,013,633 | 3/1977 | Haase et al. | 96/29 D |

*Primary Examiner*—Richard L. Schilling

*Attorney, Agent, or Firm*—Sughrue, Rothwell, Mion, Zinn and Macpeak

[57] ABSTRACT

A photographic light-sensitive sheet for the color diffusion transfer process which comprises a support having thereon at least one light-sensitive silver halide emulsion layer with at least one of said silver halide emulsion layers having associated therewith a compound represented by the following general formula (I):

wherein Q represents a cyano group, a trifluoromethyl group or a carbamoyl group represented by the formula —$CONR^3R^4$ wherein $R^3$ represents a hydrogen atom or an alkyl group; $R^4$ represents a hydrogen atom, an alkyl group, an aralkyl group or an aryl group; and $R^3$ and $R^4$ may combine directly or through an oxygen atom to form a ring; M represents a hydrogen atom, an alkyl group, an alkoxy group, a sulfamoyl group represented by the formula —$SO_2NR^3R^4$, wherein $R^3$ and $R^4$ are as defined above, a group represented by the formula —$COOR^5$ wherein $R^5$ represents an alkyl group, a phenyl group or a substituted phenyl group; or a halogen atom; $R^{1a}$ and $R^{1b}$, which may be the same or different, each represents an alkylene group having 2 or more carbon atoms; $R^{2a}$ and $R^{2b}$, which may be the same or different each represents an alkyl group, Y represents a moiety which releases or provides, as a result of development processing under alkaline conditions, an azo dye having a different diffusibility from that of said dye image-providing material and m represents 0 or 1.

The compound is a dye image providing material which provides a yellow dye image having excellent properties.

44 Claims, 4 Drawing Figures

PHOTOGRAPHIC LIGHT-SENSITIVE SHEET FOR THE COLOR DIFFUSION TRANSFER PROCESS

BACKGROUND OF THE INVENTION

1. Field of the Invention

The present invention relates to a photographic light-sensitive sheet for the color diffusion transfer process and, more particularly, to a silver halide photographic light-sensitive sheet for the color diffusion transfer process containing a novel dye releasing redox compound.

2. Description of the Prior Art

Color diffusion transfer color image forming processes using a dye releasing redox compound are described in U.S. Pat. Nos. 3,928,312, 3,931,144, 3,942,987, 3,932,381 and 3,954,476, U.S. patent application Ser. No. 439,809, Japanese Patent Application (OPI) No. 104343/1976 and *Research Disclosure,* Vol. 130, No. 13024 (February, 1975). The term "dye releasing redox compound" herein means a compound containing therein a group referred to as a redox moiety and a dye or a dye precursor moiety. The redox moiety renders the redox compound immobile due to the presence of a ballast group attached thereto, but under alkaline conditions the compound splits and releases a compound containing the dye moiety (a dye compound). For instance, when a light-sensitive element having a light-sensitive silver halide emulsion layer and a dye-releasing redox compound associated therewith is exposed and developed with an alkaline processing solution, the redox moiety per se is oxidized in proportion to the amount of developed silver halide and the compound splits into a dye compound and a non-diffusible quinone compound. As a result, the dye compound diffuses into an image-receiving layer to provide a transferred image therein.

Examples of dye-releasing redox compounds which release yellow dyes are described in U.S. Pat. No. 3,928,312 and *Research Disclosure,* Vol. 130, No. 13024 (February, 1975), etc. However, technical problems are encountered, using the dye releasing redox compounds specifically described in such prior art, in that the transferred images have insufficient stability. For example, the light fastness of the images is not good and the images fade to a large extent in a light place. Also, the transfer of the dye compound is not adequate (i.e. the transfer speed is inferior).

Further, improved yellow dye releasing redox compounds are described in U.S. Pat. No. 4,013,633. However, further investigation has revealed that the color hue of dye compounds released from the yellow dye releasing redox compounds described above changes to a large extent with pH, and that the mordantability and transferability of the dye compounds are insufficient.

SUMMARY OF THE INVENTION

A first object of the present invention is to provide a dye releasing redox compound which provides a stable yellow dye image.

A second object of the present invention is to provide a dye releasing redox compound having a dye moiety whose color hue is excellent.

A third object of the present invention is to provide a dye releasing redox compound which provides a transferred dye image which does not substantially change hue over a wide pH range.

A fourth object of the present invention is to provide a dye releasing redox compound having a dye moiety whose transferability is high.

A fifth object of the present invention is to provide a photographic light-sensitive sheet for the color diffusion transfer process containing a dye releasing redox compound which provides a transferred dye image having a sufficiently high optical density in the presence of a relatively small amount of silver halide.

A sixth object of the present invention is to provide a so-called "negative utilizable" photographic light-sensitive sheet for the color diffusion transfer process in which the light-sensitive element may be used.

It has been found that the above-described objects are effectively attained with a photographic light-sensitive sheet with satisfactory photographic properties for the color diffusion transfer process which contains a dye releasing redox compound represented by the following general formula (I):

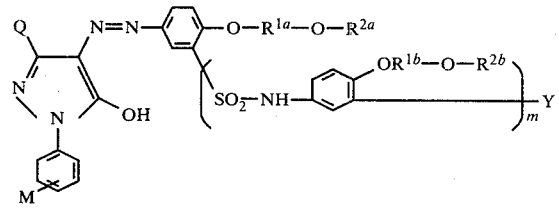

wherein Q represents a cyano group, a trifluoromethyl group or a carbamoyl group represented by the formula —$CONR^3R^4$ wherein $R^3$ represents a hydrogen atom or an alkyl group $R^4$ represents a hydrogen atom, an alkyl group, an aralkyl group or an aryl group and $R^3$ and $R^4$ may combine directly or through an oxygen atom to form a ring; M represents a hydrogen atom, an alkyl group, an alkoxy group, a sulfamoyl group represented by the formula —$SO_2NR^3R^4$ wherein $R^3$ and $R^4$ are as defined above, a group represented by the formula —$COOR^5$ wherein $R^5$ represents an alkyl group, a phenyl group or a substituted phenyl group; or a halogen atom; $R^{1a}$ and $R^{1b}$, which may be the same or different, each represents an alkylene group having 2 or more carbon atoms; $R^{2a}$ and $R^{2b}$, which may be the same or different, each represents an alkyl group, Y represents a moiety which releases or provides, as a result of development processing under alkaline conditions, an azo dye having a different diffusibility from that of said dye image-providing material and m represents 0 or 1.

BRIEF DESCRIPTION OF THE ACCOMPANYING DRAWINGS

FIGS. 1 to 4 are graphs showing the visible absorption spectrum of a mordanted dye compound. In each graph, the horizontal axis represents the wavelength in nm units and the vertical axis represents absorbance. In each graph, the solid line (—), the broken line (– –) and the dotted line (— · —) are absorption spectra measured at pH's or 9.18, 6.86 and 4.53, respectively.

DETAILED DESCRIPTION OF THE INVENTION

Figure 2:
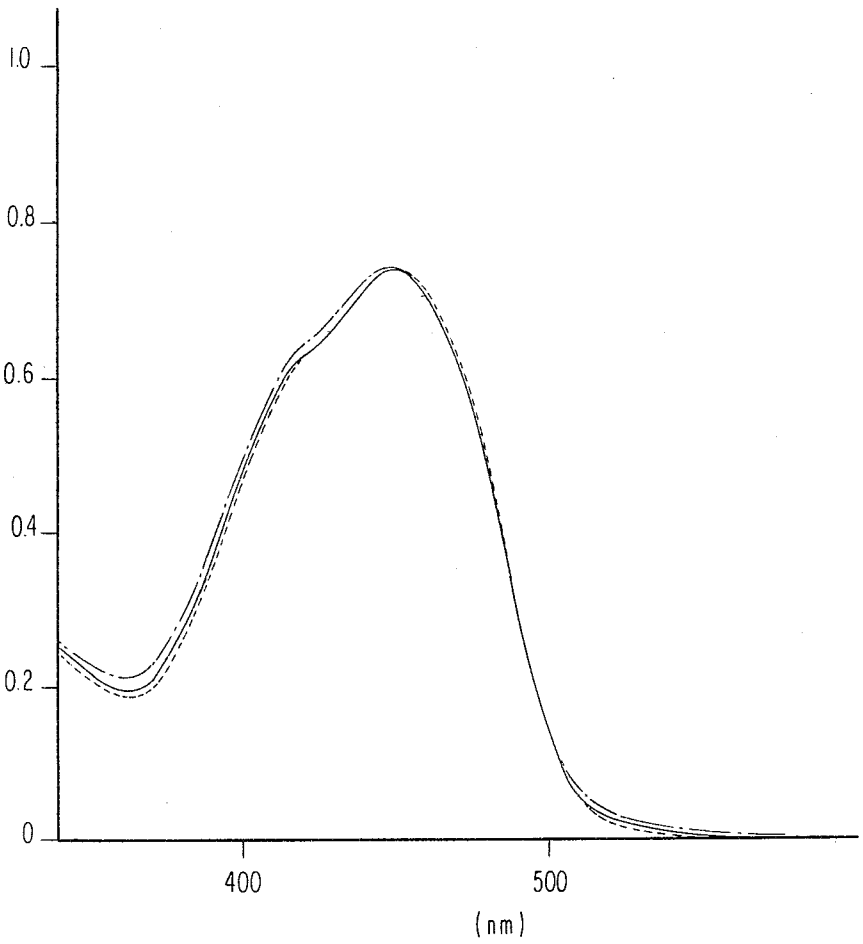

The compound in the above-described general formula is characterized by the presence of the —O—$R^{1a}$—O—$R^{2a}$ group in the dye moiety, more particularly the moiety corresponding to the diazo component. The —O—$R^{1a}$—O—$R^{2a}$ group positioned at the 4-position to the azo group and the —$SO_2NH$—group positioned at the 3-position is another characteristic of the compound. The relative position of these two groups is responsible for preventing a change in the color hue with a change in pH as described in greater detail below. Still another characteristic of the compound is that when m represents 0 in the formula (I), the —O—$R^{1a}$—O—$R^{2a}$ group and Y are positioned ortho to each other. It is believed that this structural feature intensifies the function of Y as a redox moiety and, thus, the dye compound is effectively released from the dye-releasing redox compound resulting in improved transferability.

In this connection, the effects of the —O—$R^{1a}$—O—$R^{2a}$ group positioned at the 4-position to the azo group have neither been known nor suggested by the prior art, for example, the technology described in the references discussed above.

The alkylene group having 2 or more carbon atoms represented by $R^{1a}$ or $R^{1b}$ can be a straight chain or branched chain alkylene group. An alkylene group having 2 to 8 carbon atoms is preferred. Although $R^{1a}$ and $R^{1b}$ can form a branched chain group, a branched chain group which forms an acetal linkage (explained below) is excluded. Particularly preferred examples of $R^{1a}$ or $R^{1b}$ are a straight chain alkylene group represented by the formula —$(CH_2)_p$—, wherein p is an integer of 2 to 4, and a branched chain alkylene group having 3 or 4 carbon atoms such as —$CH(CH_3)CH_2$—and —$CH_2CH_2CH(CH_3)$— with an alkylene group which forms an acetal linkage being excluded. From the standpoint of the availability of starting materials, a —$CH_2CH_2$— group is particularly advantageous for $R^{1a}$ or $R^{1b}$. When $R^{1a}$ or $R^{1b}$ represents a methylene group, an acetal linkage, in this case a —O—$CH_2$—O—$R^{2a}$ or —O—$CH_2$—O—$R^{2b}$ linkage, is formed, which is undesirable since it is chemically unstable, particularly under acidic conditions, and tends to decompose during preparation. For the same reason, any groups wherein two oxygen atoms are bonded to the same carbon atom in the $R^{1a}$ or $R^{1b}$ group of the —O—$R^{1a}$—O—$R^{2a}$ group or the —O—$R^{1b}$—O—$R^{2b}$ group (i.e., an acetal linkage), are also undesirable.

The alkyl group represented by $R^{2a}$ or $R^{2b}$ can be a straight chain or branched chain alkyl group and may be substituted or unsubstituted and preferably is an unsubstituted alkyl group having 1 to 8 carbon atoms. A particularly preferred example of $R^{2a}$ or $R^{2b}$ is a straight chain or branched chain alkyl group having 1 to 4 carbon atoms (for example, a methyl group, an ethyl group, an n-propyl group, an isopropyl group, an n-butyl group, etc.). In particular, a methyl group or an ethyl group, most particularly, a methyl group is preferred for $R^{2a}$ or $R^{2b}$.

Suitable substituents which can be present on the alkyl group for $R^{2a}$ or $R^{2b}$ include, for example, an alkoxy group having 1 to 8 carbon atoms, preferably 1 to 4 carbon atoms (for example, a methoxy group, an ethoxy group, etc.), a dialkylamino group having 1 to 8 carbon atoms, preferably 1 to 4 carbon atoms, in each alkyl moiety (for example, a diethylamino group, etc.), and the like.

A cyano group is particularly preferred for Q in view of the fastness of the transferred dye compounds.

In the carbamoyl group represented by the formula —$CONR^3R^4$ for Q, $R^3$ is preferably a hydrogen atom, an alkyl group having 1 to 8 carbon atoms (more preferably 1 to 4 carbon atoms). The alkyl group is straight chain, branched chain or cyclic and may be substituted or unsubstituted, $R^4$ is preferably a hydrogen atom, an alkyl group having 1 to 8 carbon atoms (more preferably 1 to 4 carbon atoms) which may be straight chain, branched chain or cyclic and substituted or unsubstituted, an aralkyl group having 7 to 15 carbon atoms (more preferably 7 to 10 carbon atoms) which may be substituted or unsubstituted (for example a benzyl group), or an aryl group having 6 to 14 carbon atoms (more preferably 6 to 9 carbon atoms) which may be substituted (for example a phenyl group). The aryl group or aryl moiety in the aralkyl group may be monocyclic. Also, $R^3$ and $R^4$ may be combined directly or through an oxygen atom to form a 5- or 6-membered ring. Examples of the cyclic group formed when $R^3$ and $R^4$ combine are analogous to those shown below for the sulfamoyl group M. The cases where: (i) $R^3$ and $R^4$ each represents a hydrogen atom and (ii) one of $R^3$ and $R^4$ represents a hydrogen atom and the other of $R^3$ and $R^4$ represents an alkyl group having 1 to 4 carbon atoms, are particularly preferred because of the easy availability of the starting marterials and excellent transferability of the dye compound formed.

The alkyl group represented by M is a straight chain, branched chain or cyclic substituted or unsubstituted alkyl group having 1 to 8 carbon atoms (more preferably 1 to 4 carbon atoms) in the alkyl moiety. Examples of substituents for the substituted alkyl group include those disclosed for $R^3$ to $R^5$ below.

The alkoxy group represented by M is preferably an alkoxy group having 1 to 8 carbon atoms (more preferably 1 to 4 carbon atoms) in the alkyl moiety wherein the alkyl moiety is straight chain, branched chain or cyclic and may be substituted or unsubstituted. Examples of substituents for the substituted alkoxy group include those described for $R^3$ to $R^5$ below.

In the sulfamoyl group represented by the formula —$SO_2NR^3R^4$ for M, $R^3$ is preferably a hydrogen atom or an alkyl group having 1 to 8 carbon atoms (more preferably 1 to 4 carbon atoms in the alkyl moiety) wherein the alkyl group may be straight chain, branched chain or cyclic, and may be substituted or unsubstituted. $R^4$ is preferably a hydrogen atom, an alkyl group having 1 to 8 carbon atoms (more preferably 1 to 4 carbon atoms) wherein the alkyl groups may be straight chain, branched chain or cyclic and may be substituted or unsubstituted, an aralkyl group having 7 to 15 carbon atoms (more preferably 7 to 10 carbon atoms) which may be substituted or unsubstituted (for example, a benzyl group), or an aryl group having 6 to 14 carbon atoms (more preferably 6 to 9 carbon atoms) which may be substituted or unsubstituted (for example, a phenyl group). Also, $R^3$ and $R^4$ may be combined directly or through an oxygen atom to form a 5- or 6-membered ring. The cases where (i) $R^3$ and $R^4$ each represents a hydrogen atom or (ii) one of $R^3$ and $R^4$ represents a hydrogen atom and the other of $R^3$ and $R^4$ represents an alkyl group having 1 to 4 carbon atoms, are particularly preferred because of easy availability of the starting materials and excellent transferability of the dye compound formed.

Examples of the cyclic group formed when $R_3$ and $R_4$ combine are as follows:

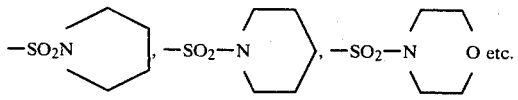

In case of the —COOR$^5$ group, R$^5$ preferably represents an alkyl group having 1 to 8 carbon atoms (more preferably 1 to 4 carbon atoms) in the alkyl moiety where the alkyl group may be straight chain, branched chain or cyclic and substituted or unsubstituted, a phenyl group or a substituted phenyl group having 6 to 9 carbon atoms.

Examples of suitable substituents which can be present in the above-described substituted alkyl groups represented by R$^3$ and R$^5$ include one or more of a cyano group, an alkoxy group having 1 to 8 carbon atoms, preferably 1 to 4 carbon atoms, a hydroxy group, a carboxy group, a sulfo group, etc.

Further, examples of suitable substituents which can be present in the above-described substituted aryl group and aralkyl group represented by R$^4$ or R$^5$ include one or more of a hydroxy group, a halogen atom, a carboxy group, a sulfo group, a sulfamoyl group, an alkoxy group having 1 to 8 carbon atoms, preferably 1 to 4 carbon atoms, etc.

The halogen atom represented by M may be flourine, chlorine bromine or iodine, but a chlorine atom is particularly preferred.

Y represents a moiety which releases or provides, as a result of development processing under alkaline conditions, an azo dye having a different diffusibility form that of the azo dye image providing material.

As the azo dye image providing materials, there are illustrated non-diffusible image providing materials (azo dye-releasing redox compounds) which provide a diffusible dye as a result of self splitting due to oxidation by the development processing. Examples of Y effective for this type of compound are N-substituted sulfamoyl groups. For example, there can be illustrated as Y the group represented by following formula (A):

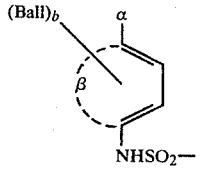

(A)

In the above formula, $\beta$ represents non-metallic atoms necessary to complete a benzene ring, to which a carbon ring or a hetero ring may be fused to form, for example, a naphthalene ring, a quinoline ring, a 5,6,7,8-tetrahydronaphthalene ring, a chroman ring, etc. Further, said benzene ring or said ring wherein a carbon ring or hetero ring is fused to the benzene ring may have a substituent or substituents such as a halogen atom, an alkyl group, an alkoxy group, an aryl group, an aryloxy group, a nitro group, an amino group, an alkylamino group, an arylamino group, an amido group, a cyano group, an alkylmercapto group, a keto group, a carboalkoxy group, a hetero ring group, etc.

$\alpha$ represents an —OG$^1$ or —NHG$^2$ group, wherein G$^1$ represents a hydrogen atom or a group capable of forming a hydroxyl group by hydrolysis, and preferably represents a hydrogen atom,

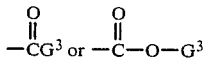

wherein G$^3$ represents an alkyl group, in particular alkyl group having 1–18 carbon atoms (such as a methyl group, an ethyl group, a propyl group, etc.), a halogen-substituted alkyl group having 1–18 carbon atoms (such as a chloromethyl group, a trifluoromethyl group, etc.), a phenyl group or a substituted phenyl group, and G$^2$ represents a hydrogen atom, an alkyl group having 1–22 carbon atoms or a hydrolyzable group. Preferable examples of said hydrolyzable group represented by G$^2$ are

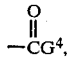

—SO$_2$G$^5$ or —SOG$^5$, wherein G$^4$ represents an alkyl group having 1 to 4 carbon atoms (such as a methyl group); a halogen-substituted alkyl group (such as mono-, di- or tri-chloromethyl group or a trifluoromethyl group); an alkylcarbonyl group (such as an acetyl group); an alkoxy group; a substituted phenyl group (such as nitrophenyl group or a cyanophenyl group); a phenyloxy group unsubstituted or substituted by a lower alkyl group or a halogen atom; a carboxyl group; an alkyloxycarbonyl group; an aryloxycarbonyl group; an alkylsulfonylethoxy group; or an arylsulfonylethoxy group, and G$^5$ represents a substituted or unsubstituted alkyl or aryl group.

Further, b is an integer of 0, 1 or 2, and b represents 1 or 2, preferably 1, except when said $\alpha$ represents —NHG$^2$ wherein G$^2$ represents an alkyl group making the compound of general formula (A) immobile and non-diffusible, namely, when $\alpha$ represents a group represented by —OG$^1$ or —NHG$^2$ wherein G$^2$ represents a hydrogen atom, an alkyl group having 1–8 carbon atoms or a hydrolyzable group. Ball represents a ballast group which will be described in detail hereinafter.

Specific examples of this type Y are described in U.S. Published Application No. B351,673, U.S. Pat. No. 3,928,312 and Japanese Patent Application (OPI) No. 50,736/78.

As other examples of Y suitable for this type of compounds, there are illustrated the group represented by following formula (B);

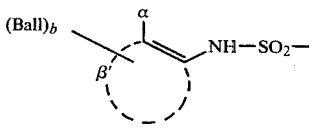

(B)

In the above formula, Ball, $\alpha$ and b are the same as defined in formula (A), $\beta'$ represents the atoms necessary to form a carbon ring, for example, a benzene ring, to which a carbon ring or a hetero ring may further be fused to form a naphthalene ring, a quinoline ring, a 5,6,7,8-tetrahydronaphthalene ring, a chroman ring, etc. The above-described various rings may be further substituted by a halogen atom, an alkyl group, an alkoxy group, an aryl group, an aryloxy group, a nitro group, an amino group, an alkylamino group, an arylamino group, an amino group, a cyano group, an alkylmercapto group, a keto group, a carboalkoxy group, a hetero ring or the like. Specific examples of this type Y are described in U.S. Pat. Nos. 4,055,428 and 4,053,312.

As the further examples of Y suitable for this type compounds, there are illustrated the group represented by general formula (C);

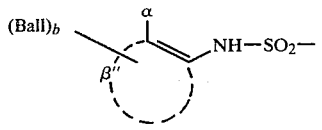

(C)

In the above formula, Ball, α and b are the same as defined in formula (A), and β'' represents atoms necessary for forming a hetero ring such as a pyrazole ring, a pyridine ring, etc. to which a carbon ring or a hetero ring may further be fused. The above-described rings may be substituted by the same substituents as those for the rings described in formula (B). Specific examples of this type Y are described in Japanese Patent Application (OPI) No. 104,343/76.

More specifically, the following Synthesis Examples indicate preparation of compounds containing the Y moiety of the general formula (C) as described in Japanese Patent Application (OPI) No. 104,343/76.

SYNTHESIS EXAMPLE (C)-A

Preparation of Dye-Providing Compound (C)-(I)

4.9 g of Compound (C)-(I), whose production is described hereinafter, was suspended in 50 ml of pyridine, followed by the addition of 4.3 g of the dye sulfochloride of the formula:

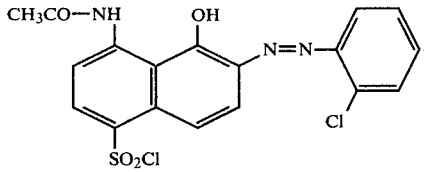

The solution was heated to 45° C. and then left to cool. Following the addition of 50 ml of water, the solution was stirred for 1 hour. The precipitate was filtered off under suction and washed with water. The residue was suspended in acetone, filtered under suction, washed with acetone and dried.

Yield: 5.2 g of Compound (C)-(1).

Compound (C)-(I) corresponding to the formula:

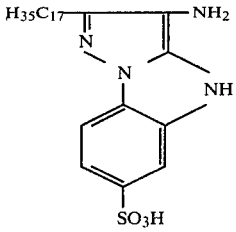

(C)-(I)

was obtained as follows:

20.7 g of the pyrazolebenzimidazole corresponding to the formula

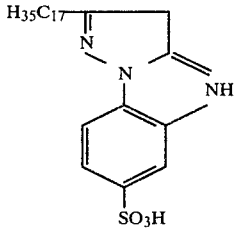

was suspended in 150 ml of glacial acetic acid, followed by the dropwise addition at room temperature of a solution of 3.3 g of $NaNO_2$ in 12 ml of water. The suspension was then stirred for 2 hours and subsequently introduced into a solution of 22.6 g of Na-dithionite in 150 ml of water, followed by stirring for 30 minutes. After filtration under suction, the product was washed with water. The residue was suspended in 250 ml of methanol, followed by the addition of 250 ml of water. The product was then heated to the boiling point, cooled, filtered under suction, washed with methanol and dried under nitrogen.

Yield: 18.2 g.

Compounds (C)-(2) and (C)-(3)

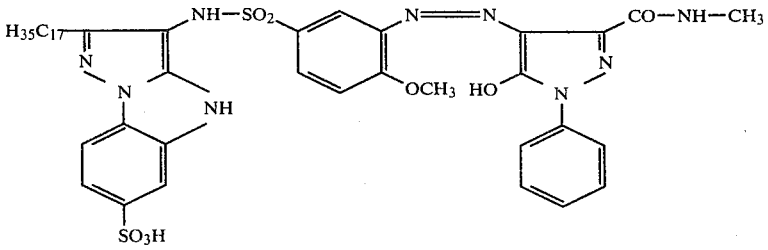

-continued

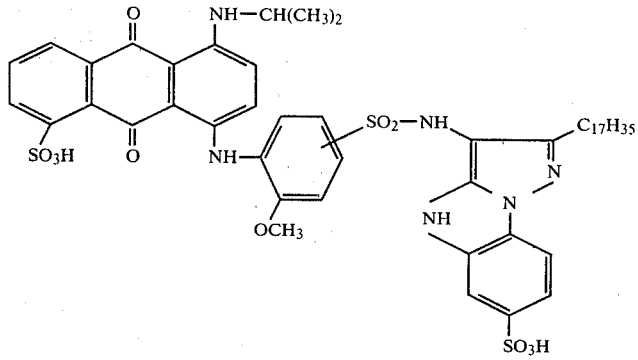

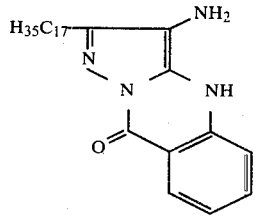

(C)-(II)

are obtained in the same way as compound by reacting Compound (C)-(I) with the dye sulfochlorides corresponding to the formulae:

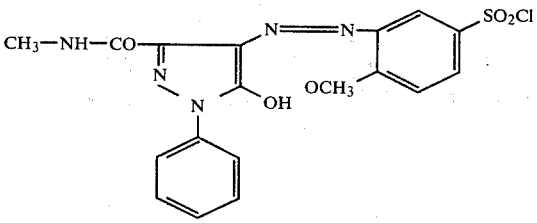

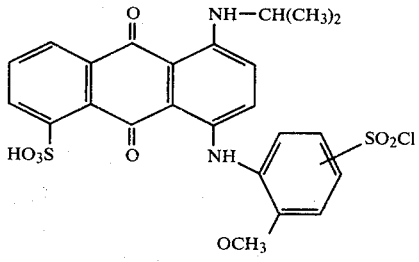

SYNTHESIS EXAMPLE (C)-B

Production of Dye-Providing Compound (C)-(4)

4.4 g of Compound (VC)-(II), whose production is described hereinafter, was suspended in 50 ml of pyridine, followed by the addition of 4.3 g of the dye sulphochloride used for the production of Compound (C)-(1). The mixture was heated to 40° C. until a solution was formed, stirred for 15 minutes at 40° C., and then cooled. 50 ml of water was added dropwise, and the precipitate was filtered off under suction and washed with water. The residue was suspended in acetone, filtered under suction, washed with a little acetone and dried.

Yield 5 g of Compound (C)-(4).

Compound (C)-(II) corresponding to the formula:

was obtained as follows:

6.2 g of Compound (C)-(III) (produced as described below) was suspended in 170 ml of glacial acetic acid, followed by the addition in portions of 9 g of zinc dust. The whole was stirred for 1 hour at room temperature and then for 30 minutes at 40° C., filtered under suction and washed with glacial acetic acid. The mother liquor was concentrated in vacuo and the greasy residue was stirred with 50 ml of methanol, filtered under suction, washed with methanol and dried under nitrogen.

Yield: 5 g of Compound (C)-(II).

Compound (C)-(III) corresponding to the formula:

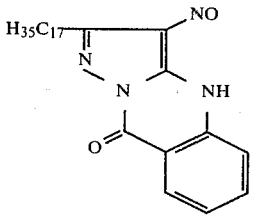

was prepared as follows:

9 g of the pyrazoloquinazolone

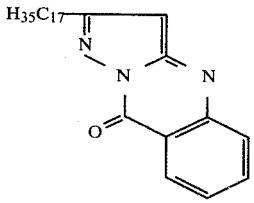

was suspended in 75 ml of glacial acetic acid, after which 1.65 of $NaNO_2$ was added and the mixture stirred for 4 hours with a positive nitrate reaction. After standing overnight, the product was filtered off under suction, washed with $H_2O$ and dried.

Yield: 7.7 g of Compound (C)-(III).

As still further examples of Y suitable for this type compounds, there are illustrated those represented by gneral formula (D);

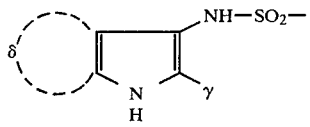

(D)

In the above formula, $\gamma$ preferably represents a hydrogen atom; an alkyl group, aryl group or hetero ring group which may be unsubstituted or substituted; or —CO—$G^6$ wherein $G^6$ represents —$OG^7$, —S—$G^7$ or

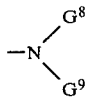

(herein $G^7$ represents a hydrogen atom, an alkyl group, a cycloalkyl group or an aryl group, which may be substituted, $G^8$ represents the same group as $G^7$ or an acyl group derived from an aliphatic or aromatic carboxylic acid or from sulfonic acid, and $G^9$ represents a hydrogen atom or a substituted or unsubstituted alkyl group), $\delta$ represents the atoms necessary for completing a fused benzene ring which ring may have one or more substituents, and $\gamma$ and/or the substituents on said fused benzene ring completed by $\delta$ is a ballast group or a ballast-containing group. Specific examples of this type Y are described in Japanese Patent Application (OPI) Nos. 104,343/76 and 46,730/78.

More specifically, the following Synthesis Example indicate preparation of a compound containing the Y moiety of the general formula (D) as described in Japanese Patent Application (OPI) No. 46730/78.

SYNTHESIS EXAMPLE (D)-1

Preparation of Dye-Providing Compound (D)-(1)

5-Methoxyindole-2-carboxylic acid ethyl ester (21.9 g) and octadecylamine (29.6 g) were admixed in 200 ml of toluene. Fifty ml of toluene was distilled off from the mixture. After cooling to 50° C., 3.65 ml of 30% sodium methoxide solution was added to the mixture. The whole was refluxed for 5 hours. To the warm reaction mixture was added 475 ml of methanol without further heating. Then the mixture was cooled to 0° C. to afford precipitates, which were filtered under suction, washed with 200 ml of methanol, and dried. The compound represented by the following formula (D)-(I) (37.2 g) was obtained in a 84% yield. m.p. 129°-142° C.

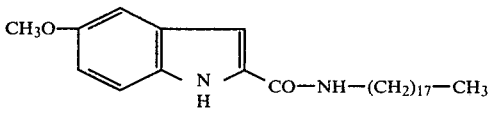

(D)-(I)

The Compound (D)-(I) (37.2 g) was dissolved in glacial acetic acid by heating slightly. To the cooled solution was added portionwise 7.6 g of sodium nitrite for 1 hour. After additional stirring for 1 hour, the reaction mixture was heated to 40° C. in a short time in order to make precipitates separable more easily by suction filtration. The mixture was cooled to 20 C., and the precipitates were filtered, under suction and washed successively with glacial acetic acid and with a large quantity of water. After drying, the compound represented by the following formula (D)-(II) (39.6 g) was obtained in a 99.7% yield.

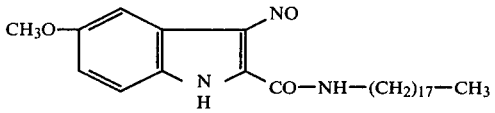

(D)-(II)

The Compound (D)-(II) (39.6 g) was separated through a fine sieve and added to 370 g of methanol under vigorous agitation. To the thick suspension obtained was added rapidly an aqueous solution (165 ml) of 41 g of sodium dithionite, followed by heating at 60°-65° C. for 2 hours. After cooling to 20° C., the precipitate was separated by filtration, washed with a 1% aqueous solution of sodium dithionite and dried. The compound represented by the following formula (D)-(III) (36 g) was obtained in a 91% yield.

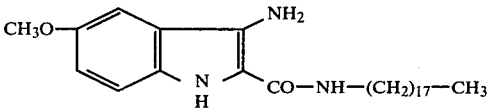

(D)-(III)

The Compound (D)-(III) was dissolved in 50 ml of chloroform, followed by the addition of 2 ml of pyridine and 5.5 g of the dye-sulfonyl chloride having the formula:

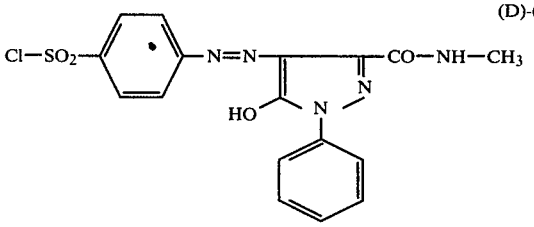

(D)-(IV)

The mixture was stirred for 1 hour. After the addition of 150 ml of methanol, the stirring was continued for an additional 3 hours. The precipitated dye was filtered under suction and dried to afford 4.4 g of Dye-Providing Compound (DF)-(1). The solid was purified as follows. The solid was dissolved in 50 ml of hot chloroform, followed by the addition of 100 ml of methanol, and then allowed to stand overnight. The compound precipitated was separated by suction filteration, washed with methanol and dried. The Dye-Providing Compound (D)-(1) (2.8 g) was obtained in a 33% yield.

Unsubstituted indole-2-carboxylic acid ethyl esters and various substituted indole-2-carboxylic acid esters are disclosed in the literature, for example, Heath-Brown and Philpott, *J. Chem. Soc.*, 1965, 7185-7193.

As still further examples of Y suitable for this type compounds, there are illustrated the group represented by general formula (E);

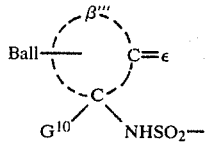

(E)

In the above formula, Ball is the same as defined in formula (A), ε represents an oxygen atom or —NG'' (G'' represents a hydroxyl group or an amino group which may be substituted) and, when ε represents =NG'', a typical example of G'' is that in =C=N—G'' formed by the dehydration reaction between a carbonyl reagent of $H_2N$—G'' and a ketone group. Examples of the compound of $H_2N$—G'', are hydroxylamines, hydrazines, semicarbazides, thiosemicarbazides, etc. To to specific, there are illustrated, as the hydrazines, hydrazIne, phenylhydrazine, substituted phenylhydrazine having in the phenyl moiety a substituent or substituents such as an alkyl group, an alkoxy group, a carboalkoxy group, a halogen atom, etc., isonicotinic acid hydrazine, etc. As the semicarbazides, there are illustrated, phenylsemicarbazide or substituted phenylsemicarbazide substituted by an alkyl group, an alkoxy group, a carboalkoxy group, a halogen atom, etc. As the semithiocarbazides, there are illustrated the same derivatives as with semicarbazides.

β''' in the formula represents a 5-, 6- or 7-membered saturated or unsaturated non-aromatic hydrocarbon. To be specific, there are illustrated, for example, cyclopentanone, cyclohexanone, cyclohexenone, cyclopentenone, cycloheptanone, cycloheptenone, etc.

These 5- to 7-membered non-aromatic hydrocarbon rings may be fused to other rings at a suitable position to form a fused ring system. As the other ring, various rings may be used regardless of whether they show aromaticity or not or whether they are hydrocarbon rings or hetero rings. However, in the case of a fused ring being formed, fused systems wherein benzene and the above-described 5- to 7-membered non-aromatic hydrocarbon ring are fused to each other such as indanone, benzcyclohexenone, benzcycloheptenone, etc. are preferable in the present invention.

The above-described 5- to 7-membered non-aromatic hydrocarbon rings or the above-described fused rings may have one or more substituents such as an alkyl group, an aryl group, an alkyloxy group, an aryloxy group, an alkylcarbonyl group, an arylcarbonyl group, an alkylsulfonyl group, an arylsulfonyl group, a halogen atom, a nitro group, an amino group, an alkylamino group, an arylamino group, an amido group, an alkylamido gorup, an arylamido group, a cyano group, an alkylmercapto group, an alkyloxycarbonyl group, etc.

$G^{10}$ represents a hydrogen atom, or a halogen atom such as fluorine, chlorine or bromine.

Specific examples of this type Y are described in Japanese Patent Application (OPI) No. 3,819/78.

More specifically, the following Synthesis Examples indicate preparation of compounds containing the Y moiety of the general formula (E) as described in Japanese Patent Application (OPI) No. 3,819/78.

SYNTHESIS EXAMPLE (E)-(1)

Preparation of Compound (E)-(1)

(1) Preparation of 4-(2,5-di-tert-amylphenoxyacetamide)-2-nitroso-1-indanone 18 g of 4-(2,5-di-tert-amylphenoxyacetamide)-1-indanone was dissolved into 100 ml of benzene. While blowing hydrogen chloride thereinto, 4.2 g of isoamyl nitrite was added thereinto at room temperature.

After stirring for three hours, crystals were collected by the filtration. The collected crystals were washed with benzene and then recrystallized from ethanol to obtain 13.5 g of the intended compound of m.p. 223° C. to 225° C.

(2) Preparation of 4-(2,5-di-tert-aminophenoxyacetamido)-2-amino-1-indanone hydrochloride 6.8 g of 4-(2,5-di-tert-aminophenoxyacetamido)-2-nitro-1-indanone was dissolved into 140 ml of tetrahydrofuran. The resulting solution was added with 20 ml of ethanol and a small amount of Raney nickel and then reduced with hydrogen. After the termination of the reaction, hydrogen chloride was blown in and the catalyst was filtered off. Then the filtrate was concentrated under vacuum. The crystals obtained were collected through a filter and washed with ethyl acetate to obtain 7.1 g of the intended compound of more than 300° C. m.p. (which began to discolor gradually into a reddish violet color at a temperature above 160° C.).

(3) Preparation of Compound (E)-(1)

4.8 g of 4-(2,5-di-tert-aminophenoxyacetamido)-2-amino-1-indanone hydrochloride was added to 200 ml of pyridine under a nitrogen atmosphere and with ice cooling. Further, 4.0 g of 4-(3'-chloro-4'-hydroxyphenylazo)-1-benzenesulfonyl chloride was added thereinto and the reaction was carried out at room temperature for two hours. After the termination of the reaction, the resultant mixture was poured into diluted hydrochloric acid.

The precipitate formed was collected by filtration. The precipitate was refined by silica gel chromatography to obtain 4.2 g of the intended compound of m.p. 113° to 116° C.

SYNTHESIS EXAMPLE (E)-(2)

Preparation of Compound (E)-(2)

4.8 g of 4-(2,5-di-tert-aminophenoxyacetamido)-2-amino-1-indanone hydrochloride was added to 200 ml of pyridine under a nitrogen atmosphere and with ice cooling. Further, 5.4 g of 4-(3'-chlorosulfonylphenylazo)-1-phenyl-5-pyrazolone was added thereinto and the reaction was carried out with ice cooling for two hours. After the termination of the reaction, the resultant mixture was poured into cool diluted hydrochloric acid. The precipitate was collected by filtration, water-washed and recrystallized from a mixed solvent of benzene and n-hexane to obtain 4.7 g of the intended compound of m.p. 123° C. to 126° C.

SYNTHESIS EXAMPLE (E)-(3)

Preparation of Compound (E)-(3)

4.8 g of 4-(2,5-di-tert-aminophenoxyacetamido)-2-amino-1-indanone hydrochloride was added to 200 ml of pyridine under a nitrogen atmosphere and with ice cooling. Further, 4.8 g of 2-(3'-chlorosulfonylphenylazo)-4-propoxy-1-naphthol was added thereto and the reaction was carried out for two hours. After the termination of the reaction, the resultant mixture was poured into cool diluted hydrochloric acid. The precipitate was recovered, water-washed and refined by silica gel chromatography to obtain the intended compound of m.p. 118°–121° C.

As the still further examples of Y for the compounds of the present invention, there are those described in, for example, U.S. Pat. Nos. 3,443,930, 3,443,939, 3,628,952, 3,844,785 and 3,443,943.

As the different type compounds of the dye-releasing redox compounds, there are illustrated non-diffusible dye image-providing compounds which release a diffusible dye under alkaline condition through self cyclization or the like but substantially do not release the dye when reacted with the oxidation production of a developing agent.

As examples of Y effective for this type compounds, there are illustrated those represented by formula (F);

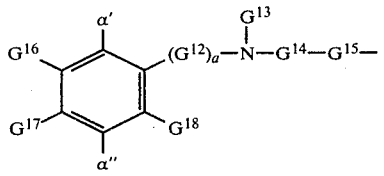

(F)

In the above formula, $\alpha'$ represents an oxidizable nucleophilic group such as a hydroxyl group, a primary or secondary amino group, a hydroxyamino group or a sulfonamino group, or the precursor thereof, and preferably represents a hydroxyl group.

$\alpha''$ represents a dialkylamino group or any of those defined for $\alpha'$, preferably a hydroxyl group. $G^{14}$ represents an electrophilic group such as —CO—, —CS—, etc., preferably —CO—. $G^{15}$ represents an oxygen atom, a sulfur atom, a selenium atom, a nitrogen atom, etc. and, when $G^{15}$ represents a nitrogen atom, it may be substituted by a hydrogen atom, an unsubstituted or substituted alkyl group having 1 to 10 carbon atoms, or an aromatic compound residue having 6 to 20 carbon atoms. Preferably $G^{15}$ is an oxygen atom. $G^{12}$ represents an alkylene group containing 1 to 3 carbon atoms, and a represents 0 or 1, preferably 0. $G^{13}$ is a substituted or unsubstituted alkyl group containing 1 to 40 carbon atoms or a substituted or unsubstituted aryl group containikng 6 to 40 carbon atoms, preferably an alkyl group. $G^{16}$, $G^{17}$ and $G^{18}$ each represents a hydrogen atom, a halogen atom, a carbonyl group, a sulfamyl group, a sulfonamido group, an alkyloxy group containing 1 to 40 carbon atoms, or the same as defined for $G^{13}$ or, when taken together, $G^{16}$ and $G^{17}$ may form a 5- to 7-membered ring. Also, $G^{17}$ may be $$-(G^{12})_a-\overset{\overset{\displaystyle G^{13}}{|}}{N}-G^{14}-G^{15}-,$$

provided that at least one of $G^{13}$, $G^{16}$, $G^{17}$ and $G^{18}$ represents a ballast group.

Specific examples of this type Y are described in U.S. Pat. No. 3,980,479.

As examples of Y suitable for this type compounds, there are further illustrated the group represented by general formula (G);

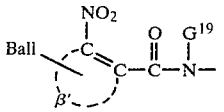

(G)

wherein Ball and $\beta'$ are the same as defined in (B), and $G^{19}$ represents an alkyl group (including substituted alkyl group). Specific examples of this type Y are described in Japanese Patent Application (OPI) No. 35,533/78.

As the examples of Y suitable for this type compounds, there are further illustrated the group represented by general formula (H);

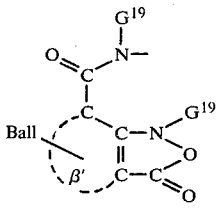

(H)

wherein Ball and $\beta'$ are the same as defined in formula (B), and $G^{19}$ is the same as defined in formula (G). Specific examples of this type Y are described in U.S. Pat. No. 3,421,964 and Japanese Patent Application (OPI) No. 4,819/77.

As the different type compounds of the azo dye image-providing compounds, there are illustrated non-diffusible compounds (dye-releasing couplers) which release a diffusible dye upon coupling reaction with an oxidation product of a color developing agent oxidized by silver halide. As the examples of Y effective for such compounds, the groups described in U.S. Pat. No. 3,227,550 are typical. For example, there are illustrated as Y those represented by the following general formula (J);

$$(\text{Ball-Coup})_t\text{—Link—} \qquad \text{(J)}$$

wherein Coup represents a coupler residue capable of coupling with an oxidation product of a color developing agent, for example, a 5-pyrazolone type coupler residue, a phenol type coupler residue, a naphthol type coupler residue, an indanone type coupler residue or an open chain keto- methylene coupler residue. Ball represents a ballast group. Link represents a group bonded to an active cite of Coup moiety, which bond with Coup moiety will be split upon coupling reaction between the dye image-providing material represented by formula (I) containing the group represented by formula (J) as Y and an oxidation product of a color developing agent. Examples of the Link are an azo group, an azoxy group, —O—, —Hg—, an alkylidene group, —S—,—S—S or —$NHSO_2$—, and t represents 1 or 2 when Link represents an alkylidene group or represents 1 when Link represents other group described above.

Of groups Y represented by formula (J), preferable groups are those wherein Coup represents a phenol type coupler residue, a naphthol type coupler residue or an indanone type coupler residue, and Link represents —$NHSO_2$—.

As the still different type compounds of the dye image-providing materials, there are illustrated the compounds (dye developing agent) which are initially diffusible under alkaline conditions but, when oxidized through development processing, become non-diffusible. Typical examples of Y effective for this type compounds are those described in U.S. Pat. No. 2,983,606.

Of the above-described compounds, particularly preferable ones are dye-releasing redox compounds and effective groups Y are N-substituted sulfamoyl groups. As the N-substituents for the N-substituted sulfamoyl groups, carbon ring groups (in particular, o- or p-hydroxyaryl groups having a ballast group bonded thereto being preferable) or hetero ring groups are desirable. As the examples of N-carbon ring substituted sulfamoyl groups, those represented by formulae (A) and (B) are particularly preferable. As the examples of N-hetero ring substituted sulfomoyl groups, those represented by formulae (AC) and (D) are particularly preferable.

As Y, the group represented by general formula (II) are particularly preferable.

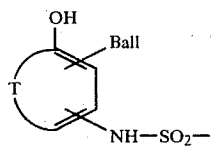

(II)

wherein Ball represents a ballast group; T represents the atomic group necessary to complete a benzene ring, which may be unsubstituted or substituted, or a naphthalene ring, which may be unsubstituted or substituted, the —$NHSO_2$— group is present at the o- or p-position to the hydroxy group; and when T represents the atoms necessary to complete a naphthalene ring Ball can be bonded to either of the two rings.

Examples of suitable substituents which can be present on the benzene ring or the naphthalene ring include, for example, an alkyl group (preferably an alkyl group having 1 to 7 carbon atoms, particularly 1 to 4 carbon atoms, halogen atom (such as a chlorine atom, etc.), etc.

The ballast group, Ball, is an organic ballast group capable of rendering the dye-releasing redox compound non-diffusible during development in an alkaline processing solution and preferably contains a hydrophobic residue having 8 to 32 carbon atoms. This organic ballast group can be bonded to the dye-releasing redox compound directly or through a linking group, for example, an imino bond, and ether bond, a thioether bond, a carbonamido bond, a sulfonamido bond, a ureido bond, an ester bond, an imido bond, a carbamoyl bond, a sulfamoyl bond, etc.

Specific examples of ballast groups are an alkyl group or an alkenyl group (e.g., a dodecyl group, an octadecyl group, etc.), an alkoxyalkyl group, (e.g., a 3-(octyloxy)-propyl group, a 3-(2-ethylundecyloxy)propyl group, etc., as described in Japanese Patent Publication No. 27563/1964, etc.), an alkylaryl group (e.g., a 4-nonylphenyl group, a 2,4-di-tert-butylphenyl group, etc.), an alkylaryloxyalkyl group (e.g., a 2,4-di-tert-pentylphenoxymethyl group, an α-(2,4-di-tert-phenylphenoxy)propyl group, a 1-(pentadecylphenoxy)-ethyl group, etc.), an acylamidoalkyl group (e.g., a group described in U.S. Pat. Nos. 3,337,344 and 3,418,129, a 2-(N-butylhexadecanamido)ethyl group, etc.), an alkoxyaryl or aryloxyaryl group (e.g., a 4-(n-octadecyloxy)phenyl group, a 4-(4-n-dodecylphenyloxy)phenyl group, etc.), a residue containing both an alkyl or alkenyl long-chain aliphatic group and a water-solubilizing group such as a carboxy group or a sulfo group (e.g., a 1-carboxymethyl-2-nonadecenyl group, a 1-sulfoheptadecyl group, etc.), an alkyl group substituted with an ester group (e.g., a 1-ethoxycarbonylheptadecyl group, a 2-(n-dodecyloxycarbonyl)ethyl group, etc.), an alkyl group substituted with an aryl group or a heterocyclic group (e.g., a 2-[4-(3-methoxycarbonyluneicosanamido)-phenyl]ethyl group, a 2-[4-(2-n-octadecylsuccinimido)-phenyl]ethyl group, etc.), an aryl group substituted with an aryloxyalkoxycarbonyl group (e.g., a 4[2-(2,4-di-tert-pentylphenoxy)-2-methylpropyloxycarbonyl]phenyl group, etc.), etc.

Of the above-described organic ballast groups, those bonded to a bridging group and represented by the following general formulae (III) to (VI) are particularly preferred.

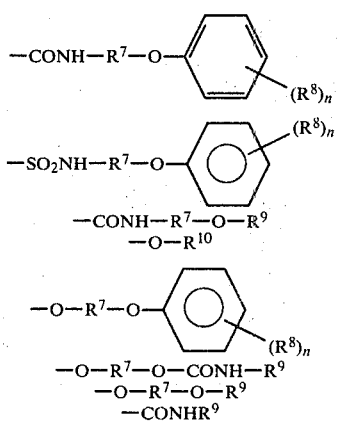

wherein $R^7$ represents an alkylene group having 1 to 10 carbon atoms, preferably 1 to 6 carbon atoms (such as a propylene group, a butylene group, etc. or an arylene group having 6 to 30 carbon atoms, preferably 6 to 20 carbon atoms (such as a phenylene group, etc.); $R^8$ represents a hydrogen atom or an alkyl group having 1 to 30 carbon atoms, preferably 1 to 20 carbon atoms (such as a tert-amyl group a pentadecyl group, etc.); n represents an integer of 1 to 5 (preferably 1 to 2); $R^9$ represents an alkyl group having 4 to 30 carbon atoms, preferably 10 to 20 carbon atoms (such as a dodecyl group, a tetradecyl group, a hexadecyl group, etc.) or a group represented by the formula

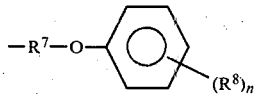

where $R^7$, $R^8$ and n have the same meaning as defined above (such as a 4-{(2,4-di-tert-amyl)phenyloxy}butyl group, etc.) and $R^{10}$ represents an alkyl group having 8 to 30 carbon atoms, preferably 10 to 20 carbon atoms (such as a hexadecyl group, an octadecyl group, etc.) including a substituted alkyl group having 8 to 30 carbon atoms in which the alkyl moiety has one or more carbon atoms, with examples of suitable substituents being one or more of, for example, a carbamoyl group, an alkoxy group having 1 to 30 carbon atoms, preferably 1 to 20 carbon atoms (such as a methoxy group, an ethoxy group, etc.), etc.

Specific examples of the sulfamoyl groups represented by the formula (II) are illustrated below:
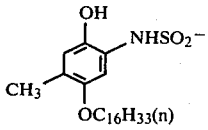
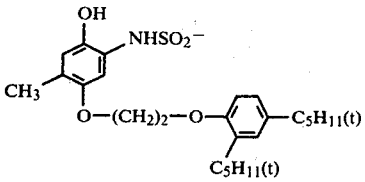
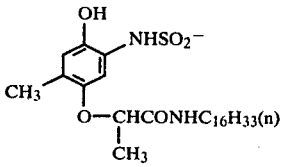
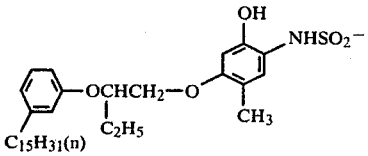
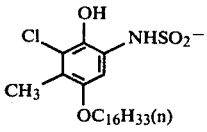
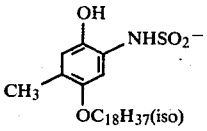
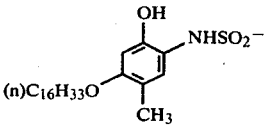
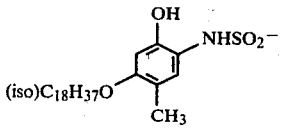
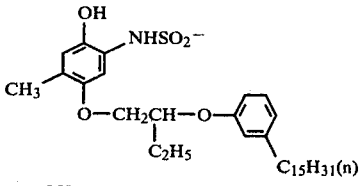
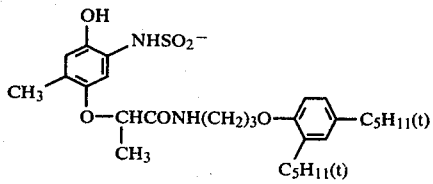
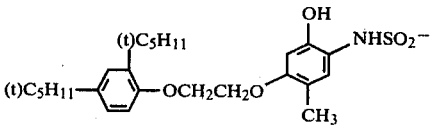
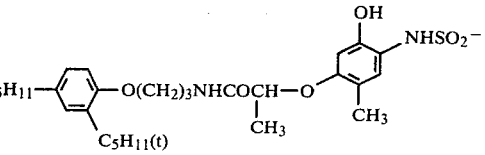
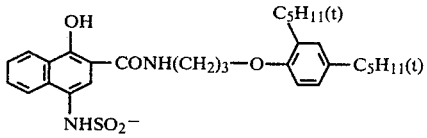
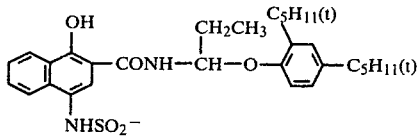
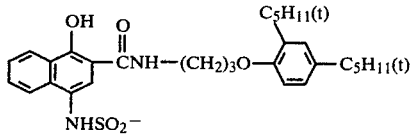
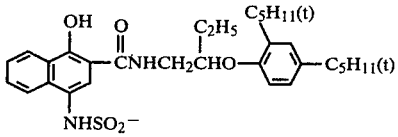
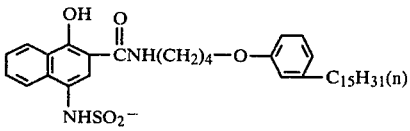
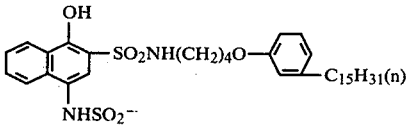
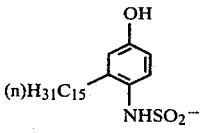
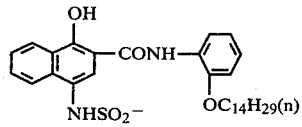
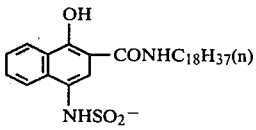
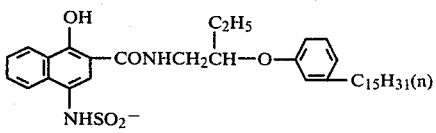
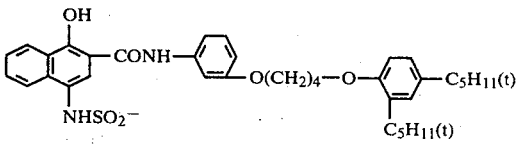

-continued

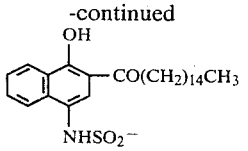

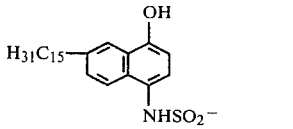

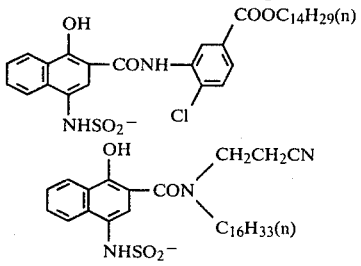

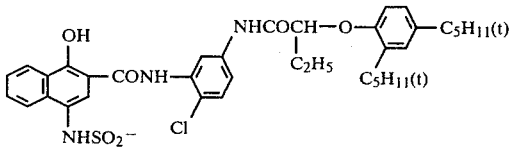

Furthermore, the groups described in *Research Disclosure,* Vol. 130, No. 13024 (Feb., 1975) are useful for Y.

A preferred compound according to the present invention is a compound represented by the above-described general formula (I), and in which $R^{1a}$ and $R^{1b}$ each represents a $—CH_2CH_2—$ group; $R^{2a}$ and $R^{2b}$, which may be the same or different, each represents a straight chain or branched chain alkyl group having 1 to 4 carbon atoms (for example, a methyl group, an ethyl group, an n-propyl group, an isopropyl group, an n-butyl group, etc.); Q represents a cyano group; M represents a hydrogen atom; m represents 0 to 1; and Y represents a sulfamoyl group represented by the general formula (II).

A particularly preferred compound according to the present invention is a compound represented by the above-described general formula (I), and in which $R^{1a}$ represents a $—CH_2CH_2—$ group; $R^{2a}$ represents a straight chain or branched chain alkyl group having 1 to 4 carbon atoms; Q represents a cyano group; M represents a hydrogen atom; m represents O; and Y represents an o-hydroxyphenylsulfamoyl group having an alkyl group at the meta position to the hydroxy group in addition to a ballast group.

Specific examples of dye releasing redox compounds according to the present invention are illustrated below. However, the present invention should not be construed as being limited to these specific examples.

COMPOUND 1

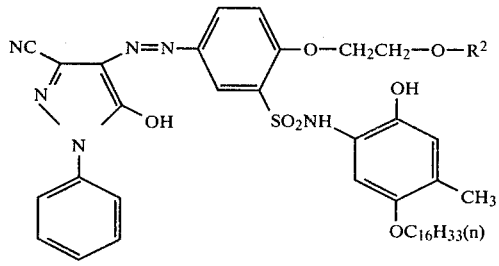

wherein $R^2$ is $CH_3$.

COMPOUND 2

Same as Compound 1 except $R^2$ is $C_2H_5$.

COMPOUND 3

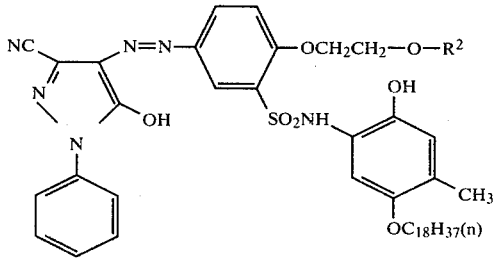

wherein $R^2$ is $CH_3$.

COMPOUND 4

Same as Compound 3 except $R^2$ is $C_2H_5$.

COMPOUND 5

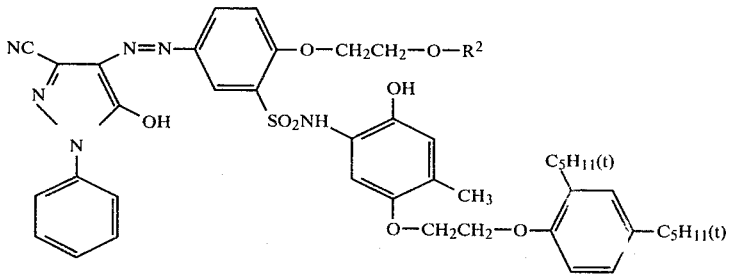

wherein $R^2$ is $CH_3$.

COMPOUND 6

Same as Compound 5 except $R^2$ is $C_2H_5$.

COMPOUND 7

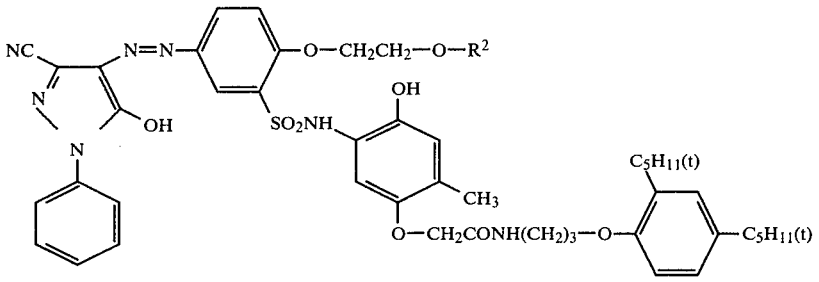
wherein $R^2$ is $CH_3$.
COMPOUND 8
Same as Compound 7 except $R^2$ is $C_2H_5$.
COMPOUND 9
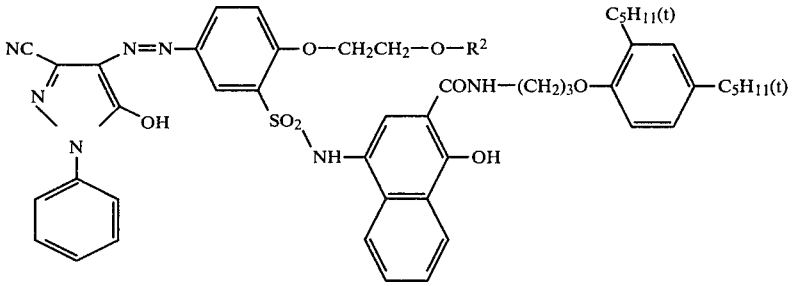
wherein $R^2$ is $CH_3$.
COMPOUND 10
Same as Compound 9 except $R^2$ is $C_2H_5$.
COMPOUND 11
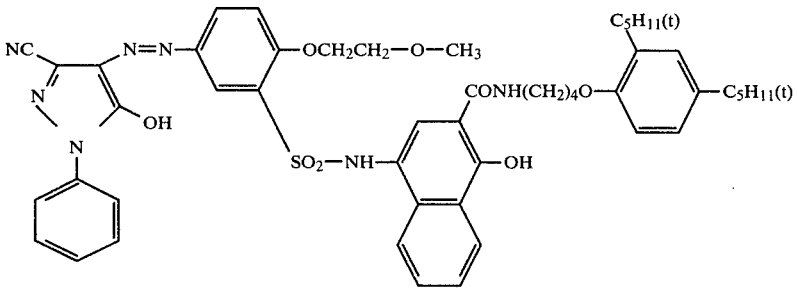
COMPOUND 12
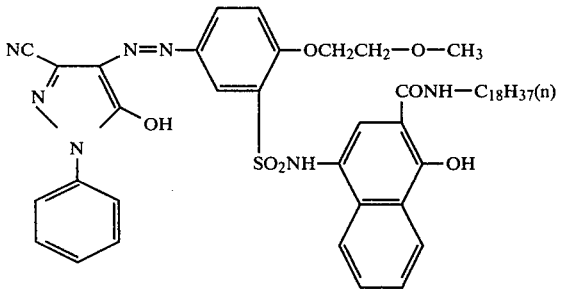

COMPOUND 13
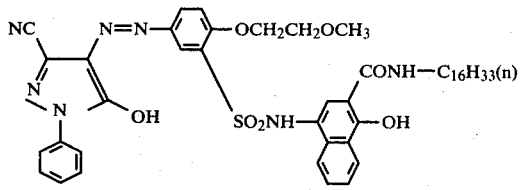
COMPOUND 14
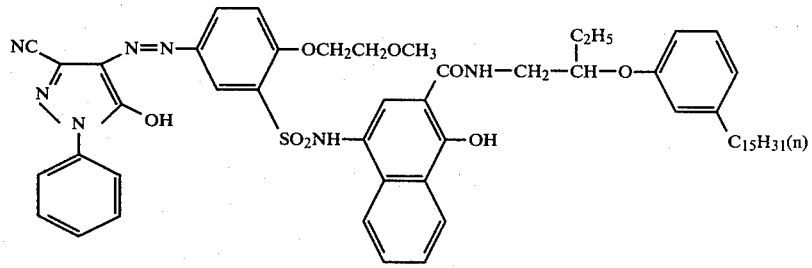
COMPOUND 15
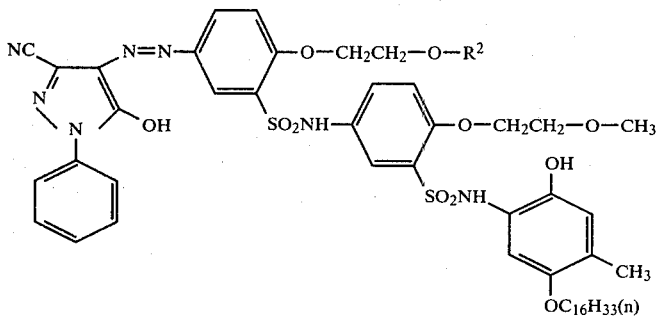
wherein $R^2$ is $CH_3$.
COMPOUND 16
Same as Compound 15 except $R^2$ is $C_2H_5$.
COMPOUND 17
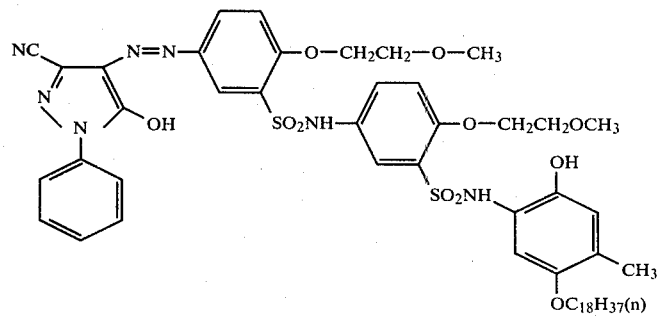

COMPOUND 18
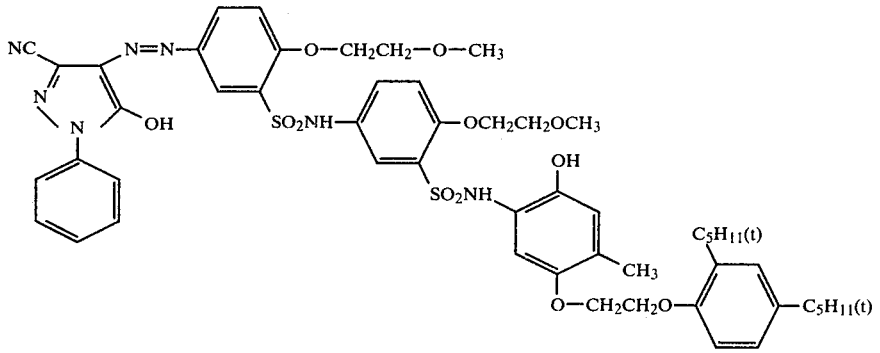
COMPOUND 19
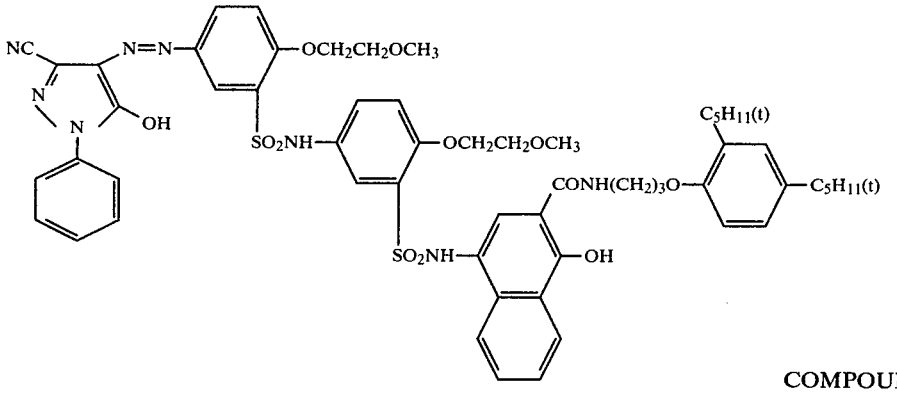
COMPOUND 20
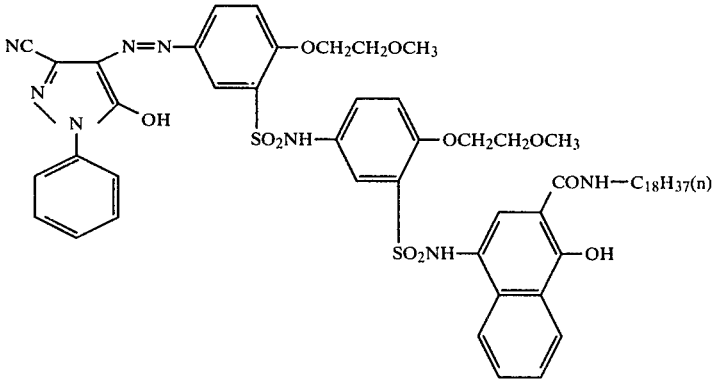
COMPOUND 21
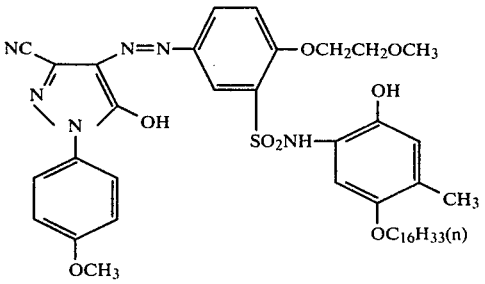

COMPOUND 22

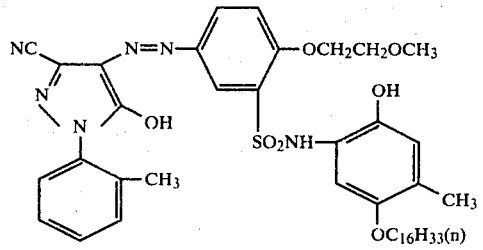

COMPOUND 23

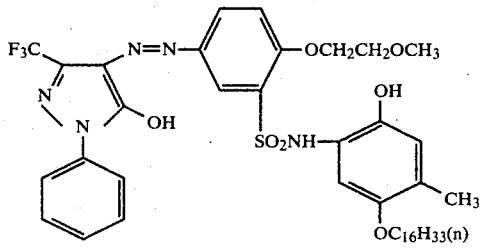

COMPOUND 24

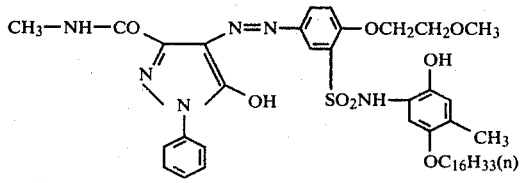

The dye-releasing redox compound according to the present invention releases a novel yellow dye compound represented by the following formula (VII) or (VIII):

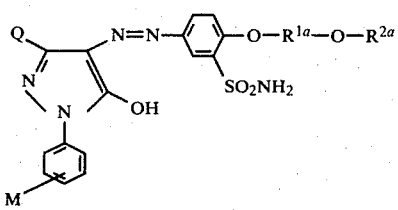

(VII)

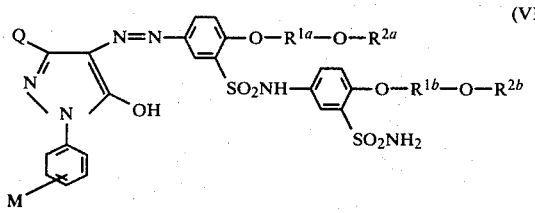

(VIII)

wherein Q, M, $R^{1a}$, $R^{1b}$, $R^{2a}$ and $R^{2b}$ each has the same meaning as defined in the general formula (I), when the compound is oxidized under alkaline conditions.

The compound according to the present invention can be obtained by a condensation reaction of a sulfonyl halide represented by the formula (IX) with an amine represented by the formula (X) or (XI):

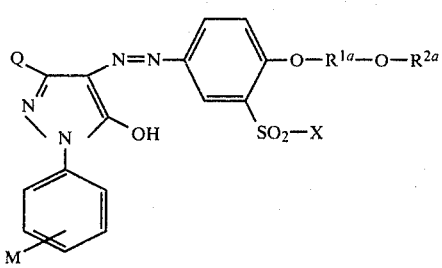

(IX)

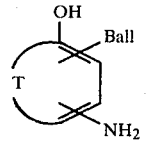

(X)

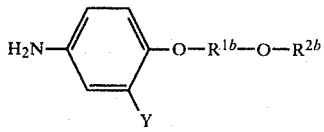

(XI)

wherein Q, M, $R^{1a}$, $R^{1b}$, $R^{2a}$, $R^{2b}$ and Y each has the same meaning as defined in the formula (I); T and Ball each has the same meaning as defined in the formula (II); and X represents a halogen atom (for example, a chlorine atom, a fluorine atom, etc.). Compounds of the formula (X) are described in U.S. Pat. No. 4,055,428 and U.S. Published Application No. B351,673.

The condensation reaction is preferably carried out in the presence of a solvent and a basic compound in an amount of about 1 to 50, preferably about 1 to 20, most preferably about 1 to 10 mols/mol of the compound represented by the formula (IX) above at a temperature of about −20° to about 200° C., preferably 0° to 150° C., most preferably 0° to 100° C. Examples of suitable basic compounds which can be employed include hydroxides of alkali metal or alkaline earth metals (for example, sodium hydroxide, potassium hydroxide, barium hydroxide, calcium hydroxide, etc.), an aliphatic amine (for example, triethylamine, etc.), an aromatic amine (for example, N,N-diethylamine, etc.), a heteroaromatic amine (for example, pyridine, quinoline, α-, β- or γ-picoline, lutidine, collidine, 4-(N-N-dimethylamino)-pyridine, etc.), or a heterocyclic base (for example, 1,5-diazabicyclo[4,3,0]nonene-5, 1,8-diazabicyclo[5,4,-0]undecene-7, etc.). A heteroaromatic amine, particularly pyridine, is preferred of the abovedescribed basic compounds when a compound represented by the formula (IX) wherein X is a chlorine atom, that is, a sulfonyl chloride is used. Examples of suitable solvents which can be employed for the condensation reaction include ethereal solvents (e.g., ether, tetrahydrofuran, dioxane, etc.); amide solvents (e.g., N,N-dimethylformamide, N,N-dimethylacetamide, N-methylpyrrolidone, etc.); haloalkane solvents; (e.g., dichloromethane, chloroform, carbon tetrachloride, 1,2-dichloroethane, etc.); ketonic solvents (e.g., acetone, methyl ethyl ketone, etc.), ester solvents (e.g., ethyl acetate etc.), and so on.

A diazo component represented by the formula (XIV) below which is required for the preparation of the compound represented by the formula (IX) can be synthesized in the following manner:

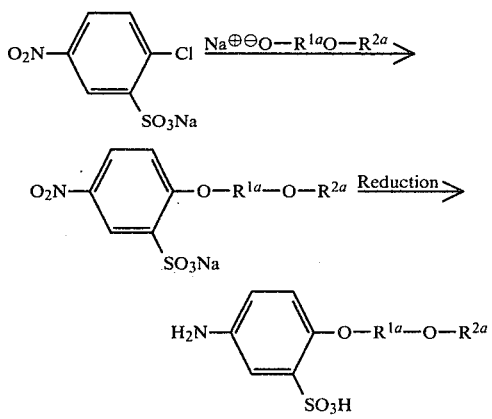

wherein $R^{1a}$ and $R^{2a}$ each has the same meaning as defined in the formula (I).

The first step is a reaction of a compound of the formula (XII) with an $R_{2a}$—O—$R^{1a}$—O— moiety. The compound represented by the formula (XII) is commercially available. The latter is obtained by treating an alcohol of the formula $R^{2a}$—O—$R^{1a}$—OH with metallic sodium or sodium hydride. The reaction for obtaining a compound of the formula (XIII) is preferably carried out using an excess amount of the alcohol of the formula $R^{2a}$—O—$R^{1a}$—OH as a solvent. The alkoxide of the formula $R_2$—O—$R^1$—ONa is used in an amount of from about 1 mol to about 50 mol, preferably from about 1 mol to about 10 mol, and more preferably, from about 1 mol to about 3 mol, per mol of the compound having the formula (XII). A suitable reaction temperature ranges from about −20° C. to about 150° C., preferably from 0° C. to 100° C., and more preferably from 30° C. to 85° C., in order to control the formation of by-products. The compound represented by the general formula (XII) and the alcohol used in this synthesis are also commercially available compounds.

Another method for obtaining a compound of the formula (XIII) is to suspend a compound of the formula (XII) in an alcohol of the formula $R^{2a}$—O—$R^{1a}$—OH which is used as a solvent, and to react with sodium hydroxide in the presence of manganese dioxide or sodium silicate ($Na_2O.nSiO_2$ wherein n is about 1 to about 3). More particularly, 1 mol of a compound of the formula (XII) and from about 10 g to about 1 kg, preferably from about 10 g to about 500 g, more preferably from about 30 g to about 100 g manganese dioxide, are suspended in from about 100 ml to about 50 , preferably from about 300 ml to about 5 l, more preferably from about 400 ml to about 2 l, of an alcohol having the formula $R^2$—O—$R^1$—OH and then treated with from about 1 mol to about 50 mol, preferably from about 1 mol to about 10 mol, more preferably from about 1 mol to about 3 mol, of sodium hydroxide. In this method, a preferred reaction temperature ranges from about 0° C. to about 150° C., more preferably from 0° C. to 100° C., most preferably from 30° C. to 85° C. This method is preferred over the former since flammable material such as metallic sodium or sodium hydride is not used.

Preferable compounds represented by general formula (XIV) are those wherein $R^1$ represents —$CH_2$—$CH_2$— and $R^2$ represents a straight or branched alkyl group having 1 to 4 carbon atoms. More preferable compounds are those within $R^1$ in the general formula represents —$CH_2$—$CH_2$—and $R_2$ represents a straight alkyl group having 1 to 4 carbon atoms. Still more preferable compounds are those wherein $R^1$ in the general formula represents —$CH_2$—$CH_2$— and $R^2$ represents a methyl group or an ethyl group.

Specific examples of the compounds represented by general formula (XIV) are illustrated below.

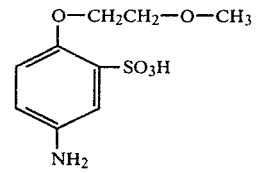

Compound (XIVa)

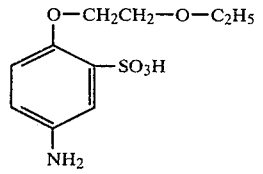

Compound (XIVb)

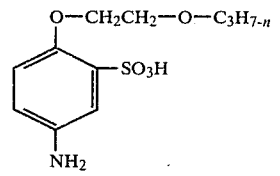

Compound (XIVc)

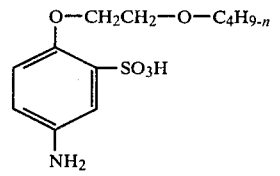

Compound (XIVd)

As the methods for reducing the nitro group of the compounds represented by general formula (XIII) to obtain compounds (I), reduction with iron dust, catalytic hydrogenation (Raney nickel or palladium-carbon catalyst), and hydrazine reduction (Raney nickel, palladium-carbon or active carbon catalyst) are typical. Other methods for reducing the nitro group to the amino group are described in, for example, R. B. Wagner et H. D. Zook; *Synthetic Organic Chemistry* CHAP. 24, pp. 654–657 (John Wiley, New York, 1953), S. R. Sandler et W. Karo; *Organic Functional Group Preparations,* CHAP. 13, pp. 339–345 ( Academic Press, London, 1968), and the like. These methods are also effective for synthesizing compounds of general formula (XIV).

The method for reducing the nitro group of the compound represented by formula (XIII) to obtain compound (XIV) will be described in more detail taking the method of reducing with iron dust for instance. About 1 mol to about 100 mols, preferably about 1 mol to about 50 mols, more preferably about 1 mols to about 10 mols, of iron dust (commercially available reduced iron or the like preferable) is used per 1 mol of the compound represented by general formula (XIII). As the solvent for the reduction reaction, water and alcohols (e.g., methanol, ethanol, methoxyethanol, etc.) are preferable. It is also possible to use these solvents in combination. Further, ammonium chloride is desirably added as a reaction initiator in a slight amount (about 1/100 to about 1/10, preferably about 1/100 to about 1/20, of the weight of the compound of general formula (XIII)).

The temperature of the above-described reaction is desirably maintained at about 30° C. to about 150° C., preferably about 50° C. to about 100° C. The thus obtained reaction solution is filtered to remove insolubles and, upon pouring the filtrate into a poor solvent (e.g., isopropyl alcohol), sodium salt of the compound of general formula (XIV) is precipitated. Also, when the filtered reaction solution described above is neutralized with conc. hydrochloric acid, there can be obtained the compound of general formula (XIV) as an inner salt.

An azo dye represented by the formula (XVI) below can be obtained by diazotizing a diazo component represented by the formula (XIV) and coupling it with a compound represented by the formula (XV), i.e., a coupler or a coupling component.

Diazotization of compound (XIV) can be conducted according to the methods described in, for example, Yutaka Hosoya; "*Shin Senryo Kagaku* (*New Dye Chemistry*)" (Gihodo, 1963), pp. 114–120, or Hiroshi Horiguchi; "*Sosetsu Gosei Senryo* (*Review on Synthetic Dyes*)", (Sankyo Shuppan, 1970), pp. 114–124. Above all, it is preferable to diazotize diazo component (XIV) according to a method usually called the reversal method. In this method, 1 mol of diazo component (XIV), about 1 mol of sodium nitrite and about 1 mol of sodium hydroxide (or hydroxide of other alkali or alkaline earth metal) are dissolved in water, and this mixture is added to a cooled mineral acid aqueous solution (e.g., dilute hydrochloric acid, dilute sulfuric acid, etc.). As the amounts of sodium nitrite and sodium hydroxide, the above-described amounts are preferable, though they may be added in excess amounts. The thus obtained solution of diazonium salt is mixed with an aqueous solvent solution or aqueous solution containing about 1 mol of the coupler of general formula (XVI) to conduct the coupling reaction. As the organic solvents for dissolving the coupler, water-miscible solvents are preferable. For example, alcohols (e.g, methanol, ethanol, 2-propanol, methoxyethanol, ethoxyethanol, etc.), carbonamides (e.g., N,N-dimethylacetamide, N,N-dimethylformamide, etc.), carboxylic acids (e.g., acetic acid, propionic acid, etc.) are preferable. It is also possible to dissolve the coupler of general formula (XV) in the mixture of these solvents. Further, the coupler of general formula (XV) may be used as an alkaline aqueous solution. Upon this coupling reaction, it is preferable to allow a basic material to coexist. As the preferable basic material, there are illustrated sodium acetate, potassium acetate, sodium hydroxide, potassium hydroxide, sodium carbonate, potassium carbonate, sodium hydrogencarbonate, etc. Details of the coupling reaction will be described hereinafter. Descriptions of the foregoing Horiguchi's book, pp. 124–129, H. E. Fierz-David et L. Blangy; *Fundamental Process of Dye Chemistry* (Interscience Publishers, Inc., New York, 1949), pp. 239–297, and K. Venkataraman; *The Chemistry of Synthetic Dyes* (Academic Press Inc., New York, 1952), CHAP.11 are also instructive.

The compound of the formula (XV) is commercially available. A compound represented by the formula (IX) is prepared by converting the sulfonic acid group of the azo dye (XVI) to a sulfonyl halide using a halogenating agent.

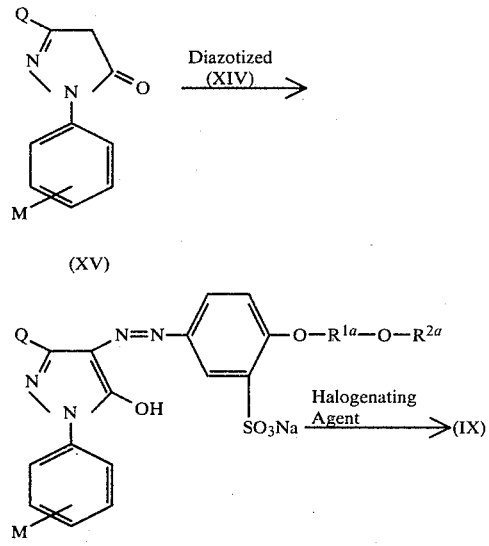

wherein Q, M, $R^{1a}$ and $R^{2a}$ each has the same meaning as defined in the formula (I).

In order to convert the compound of the formula (XVI) to a compound of the formula (IX) wherein X is Cl, a chlorinating agent such as phosphorus oxychloride ($POCl_3$), thionyl chloride ($SOCl_2$) or phosphorus pentachloride ($PCl_5$) is preferably used. The reaction is preferably carried out in the presence of N,N-dimethylacetamide, N,N-dimethylformamide, N-methylpyrrolidone, etc.

In particular, compounds of the formula (IX), wherein X represents chlorine are preferable. Synthesis of such compounds will now be described. As the chlorinating agent for converting a sulfonic acid group in general formula (XVII) to chlorosulfonyl group, there are illustrated the agents above-described. This reaction proceeds smoothly in the presence of a carboxylic acid amide such as N,N-dimethylacetamide, N,N-dimethylformamide, N-methylpyrrolidone, etc. The necessary amount of the above-described chlorinating agent is a stoichiometric amount but, in many cases, it is desirable to use it in excess (1.5 to 50 times, preferably 1.5–10 times the theoretical amount). In most cases, this reaction proceeds at room temperature (about 25° C.). Where the reaction is too vigorous, it is possible to cool it is about 0° C. On the other hand, where the reaction proceeds too slowly, the reaction system may be heated within the range of 25°–150° C. (preferably 25°–100° C.).

Compounds wherein X represents other halogenscan also be synthesized according to the method described in *Houben-Weyls Methoden der Organishen Chemie,* edited by E. Mü ller, vol. IX, pp.557–598 (1958).

A typical method for the preparation of the amine represented by the formula (XI) is schematically illustrated below:

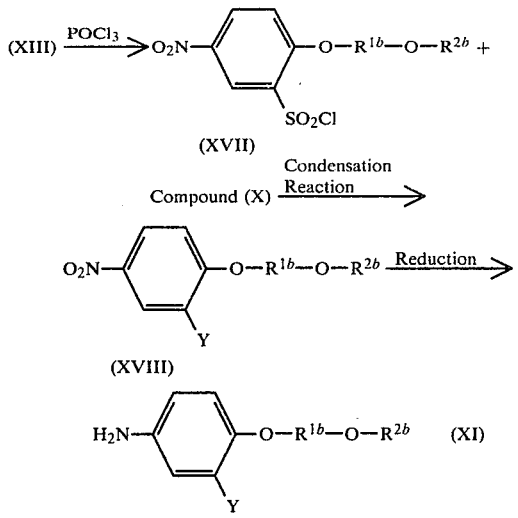

wherein $R^{1b}$, $R^{2b}$ and Y each has the same meaning as defined in the formula (I).

In order to obtain a compound represented by the formula (XVII) from a compound represented by the formula (XIII), a chlorinating agent such as those described in the preparation of the compound of the formula (IX) described above can be used. In this case, the reaction is preferably carried out in the presence of N,N-dimethylacetamide, N,N-dimethyl formamide, N-methylpyrrolidone, etc.

The condensation reaction of the sulfonyl chloride represented by the formula (XVII) and an o- or p-hydroxyarylamine having a ballast group bonded thereto represented by the formula (X) to obtain a compound of the formula (XVIII) is preferably carried out in the presence of a basic compound, with suitable examples of basic compounds being as described with respect to the reaction of the compound of the formula (IX) with the compound of the formula (X) or (XI).

Typical examples of reduction reactions for obtaining a compound represented by the formula (XI) include a catalytic hydrogenation (e.g., using Raney nickel, palladium-carbon or charcoal as a catalyst), a reduction with iron powder, a reduction with hydrazine, etc. It should be emphasized that, in the compound of the formula (XI), the basicity of the amino group is increased due to the presence of the $R^{2b}$—O—$R^{1b}$—O— group which is positioned on the p-position. Accordingly, the following condensation reaction of the compound with a sulfonyl halide of the formula (IX) proceeds easily, which is an advantage.

Typical synthesis examples of the dye releasing redox compounds used in the present invention and intermediates thereof are illustrated in detail below.

SYNTHESIS EXAMPLE 1

Synthesis of Sodium 2-(2-Methoxyethoxy)-5-nitrobenzenesulfonate [Method 1]

To a solution of sodium 2-methoxyethylate prepared by adding 7.3 g of sodium hydride (14.6 g of a 50% suspension in liquid paraffin) to 300 ml of methyl Cellosolve, was added 55 g of sodium 2-chloro-5-nitrobenzenesulfonate with stirring. The reaction mixture was heated at 80° to 85° C. on a water bath with stirring for 30 minutes. After filtering the mixture while hot, 1.5 liters of isopropyl alcohol was added to the filtrate. The crystals thus-precipitated were recovered by filtration and washed with 100 ml of isopropyl alcohol. Yield: 59 g. Melting Point: 238° to 239° C.

[Method 2]

A mixture of 5.2 g of sodium 2-chloro-5-nitrobenzenesulfonate, 0.6 g of manganese dioxide, 15 ml of methyl Cellosolve, 1 ml of water and 0.95 g of sodium hydroxide was stirred at 75°C. for 40 minutes. After cooling, the insoluble materials were removed by filtration and the filtrate was poured into 100 ml of isopropyl alcohol. The crystals thus-precipitated were recovered by filtration to obtain 4.8 g of sodium 2-(2-methoxyethoxy)-5-nitrobenzenesulfonate. Melting Point: 238° to 239° C.

[Method 3]

Using the same procedure as described in Method 2 above except 0.8 g of sodium silicate (No. 3, $Na_2O \cdot n SiO_2$ wherein n is about 3) in place of the manganese dioxide, 4.8 g of sodium 2-(2-methoxyethoxy)-5-nitrobenzenesulfonate was obtained. Similar results were obtined using $NaO_2 \cdot nSiO_2$ wherein n is about 1, about 2 and about 2.5, respectively.

SYNTHESIS EXAMPLE 2

Synthesis of Sodium 2-(2-Ethoxyethoxy)-5-nitrobenzenesulfonate

To a solution of sodium 2-ethoxyethylate prepared by adding 7.3 g of sodium hydride (14.6 g of a 50% suspension in liquid paraffin) to 300 ml of ethyl Cellosolve was added 55 g of sodium 2-chloro-5-nitrobenzenesulfonate. The reaction mixture was heated at 80° to 85° C. with stirring for 30 minutes. After completion of the reaction, the insoluble materials were removed by filtration and from the filtrate 150 ml of ethyl Cellosolve was distilled off under reduced pressure. To the concentrated solution was added 300 ml of isopropyl alcohol and the mixture was cooled with ice. The crystals which thus precipitated were recovered by filtration, washed with 100 ml of isopropyl alcohol and air-dried. Yield: 33 g. Melting Point: 248° to 249° C.

SYNTHESIS EXAMPLE 3

Synthesis of Sodium 2-(2-Butoxyethoxy)-5-nitrobenzenesulfonate

The above compound was obtained in the same manner as described in Method 2 of Synthesis Example 1 except that ethylene glycol monobutyl ether was used in place of the methyl Cellosolve. Melting Point: 104° to 160° C.

SYNTHESIS EXAMPLE 4

Synthesis of Sodium 5-Amino-2-(2-methoxyethyoxy)benzenesulfonate

A mixture solution of 30 g of sodium 2-(2-methoxyethoxy) -5-nitrobenzenesulfonate, 30 g of reduced iron, 0.6 g of ammonium chloride and 60 ml of water was heated at 80° to 85° C. with stirring for 2 hours. After completion of the reaction, the insoluble materials were removed by filtration, 200 ml of isopropyl alcohol was added to the filtrate and the mixture was cooled with ice. The crystals thus precipirated were collected by filtration, washed with 50 m of isopropyl alcohol and air-dried. Yield: 23 g. Melting Point: over 250° C.

SYNTHESIS EXAMPLE 5

Synthesis of Compound 1

(1) Synthesis of 3-Cyano-4-(4-methoxyethoxy-5-sulfonylphenylazo)-1-phenyl-5-pyrazolone To a solution containing 8.0 g of sodium hydroxide and 200 ml of water, 49.4 g of sodium 5-amino-2-(2-methoxyethoxy)- benzenesulfonate and then 50 ml of an aqueous solution containing 13.8 g of sodium nitrite were added. The solution was added dropwise to a solution containing 60 ml of concentrated hydrochloric acid and 400 ml of water at a temperature below 5° C. The mixture was stirred for 30 minutes at below 5° C. to complete the reaction. This is hereafter designated the "diazo solution".

To a solution containing 16.0 g of sodium hydroxide, 200 ml of water, 33.0 g of sodium acetate 200 ml of methyl alcohol, 37.0 g of 3-cyano-1-phenyl-5-pyrazolone was added. To the solution thus prepared, the above described diazo solution was added dropwise at a temperature below 10° C. After completion of the addition, the mixture was stirred for 30 minutes at below 10° C. and for 1 hour at room temperature. The crystals thus precipitated were collected by filtration, washed with 200 ml of acetone and air-dried. Yield: 52.0 g. Melting Point: 263° to 265° C.

(2) Synthesis of 3-Cyano-4-(4-methoxyethoxy-5-chlorosulfonyl-phenylazo)-1-phenyl-5-pyrazolone To a solution containing 51.0 g of 3-cyano-4-(4-methoxyethoxy-5-sulfophenylazo)-1-phenyl-5-pyrazolone prepared as described in Step (1) above, 250 ml of acetone and 50 ml of phosphorous oxychloride, 50 ml of N,N-dimethylacetamide was added dropwise at a temperature below 50° C. After completion of the addition, the mixture was stirred for 1 hour and was poured gradually into 1.0 liter of ice water. The crystals thus precipitated were collected by filtration, washed with 100 ml of acetonitrile and air-dried. Yield: 46.7 g. Melting Point: 181° to 183° C.

(3) Synthesis of Compound 1

To 20 ml of N,N-dimethylacetamide, 4.0 g of 2-amino-4-hexadecyloxy-5-methylphenol hydrochloride and 4.6 g of 3-cyano-4-(4-methoxyethoxy-5-chlorosulfonylphenylazo)-1-phenyl-5-pyrazolone prepared as described in Step (2) above was added. 4.7 ml of pyridine was added dropwise to the mixture with stirring and the mixture was stirred at room temperature for 2 hours. To the reaction mixture, 30 ml of methanol and 10 ml of water were added. The crystals thus precipitated were collected by filtration and recrystallized from 200 ml of acetonitrile. Yield: 5.3 g. Melting Point: 162° to 164° C.

SYNTHESIS EXAMPLE 6

Synthesis of Compound 9

To 20 ml of N,N-dimethylacetamide, 5.2 g of 4-amino-N-[3-(2,4-di-tert-pentylphenoxy)propyl]-1-hydroxy-2-naphthamide and 4.6 g of 3 -cyano-4-(4-methoxyethoxy-5-chlorosulfonylphenylazo)-1-phenyl-5-pyrazolone prepared as described in Step (2) of Synthesis Example 5 were added. 4.0 ml of pyridine was added dropwise to the mixture with stirring and the mixture was stirred at room temperature for 2 hours. After completion of the reaction, 50 ml of methanol and 10 ml of water were added to the reaction mixture. The crystals thus precipitated were collected by filtration and recrystallized from 100 ml of acetonitrile. Yield: 7.3 g. Melting Point: 150° to 153° C.

SYNTHESIS EXAMPLE 7

Synthesis of Compound 15

(a) Synthesis of 2-(2-Methoxyethoxy)-5-nitrobenzenesulfonyl Chloride 59 g of sodium 2-(2-methoxyethoxy)-5-nitrobenzenesulfonate prepared as described in Synthesis Example 1 was added to a mixture of 200 ml of acetone and 75 ml of phosphorous oxychloride. 75 ml of N,N-dimethylacetamide was added dropwise to the mixture with stirring while the reaction mixture was maintained at 30° to 40° C. After completion of the addition, the mixture was allowed to stand with stirring until it cooled to room temperature. The reaction mixture was then poured into 600 ml of ice water, stirred for 30 minutes and the crystals thus precipitated were collected by filtration. The crystals were washed with 100 ml of water and air-dried. Yield: 56 g. Melting Point: 74° to 74.5° C.

(b) Synthesis of 2-[2'-(2-Methoxyethoxy)-5'-nitrobenzenesulfonamido]-4-hexadecyloxy-5-methylphenol 20 g of 2-amino-4-hexadecyloxy-5-methylphenol hydrochloride and 18 g of 4-(2-methoxyethoxy)nitrobenzene-3-sulfonyl chloride prepared as described in Step (a) above were added to a mixture of 100 ml of tetrahydrofuran and 10 ml of pyridine and the mixture was stirred at room temperature for 3 hours. The reaction mixture was added to a mixture of 300 ml of ice water and 50 ml of concentrated hydrochloric acid with stirring. The crystals thus-precipitated were recovered with filtration, washed with water, air-dried and recrystallized from 100 ml of acetonitrile. Yield: 35 g. Melting Point: 85.5° to 86° C.

(c) Synthesis of 2-[2'-(2-Methoxyethoxy)-5'-aminobenzenesulfonamido]-4-hexadecyloxy-5-methylphenol 32 g of 2-[2'-(2-methoxyethoxy)-5'-nitrobenzenesulfonamido]-4-hexadecyloxy-5-methylphenol prepared as described in Step (b) above, 24 g of iron powder, 12 g of $Fe_3O_4$, 0.6 g of ammonium chloride and 25 ml of water were added to 300 ml of isopropyl alcohol and the mixture was refluxed on a steam bath with stirring for 1 hour. After completion of the reaction, the mixture was filtered while hot and the filtrate was cooled with ice. The crystals thus precipitated were recovered by filtration, washed with 50 ml of isopropyl alcohol and air-dried. Yield: 23 g. Melting Point: 142° to 144° C.

(d) Synthesis of Compound 15

To 20 ml of N,N-dimethylacetamide, 5.9 g of 2-[2'-(2-methoxyethoxy)-5'-aminobenzenesulfonamido]-4-hexadecyloxy-5-methylphenol prepared as described in Step (C) above and 4.6 g of 3-cyano-4-(4-methoxyethoxy-5-chlorosulfonylphenylazo)-1-phenyl-5-pyrazolone prepared as described in Step (2) of Synthesis Example 5 were added. 1.6 ml of pyridine was added dropwise to the mixture with stirring and the mixture was stirred at room temperature for 2 hours. After completion of the reaction, 30 ml of methanol and 10 ml of water were added to the reaction solution. The crystals thus precipitated were collected by filtration and recrystallized from 100 ml of acetonitrile. Yield: 8.7 g. Melting Point: 138° to 141° C.

In the reproduction of natural color by subtractive color photography, a light-sensitive element comprising at least two combinations of each of a silver halide emulsion having a selective spectral sensitivity in a certain wavelength region and a compound capable of providing a dye having a selective spectral absorption at the same wavelength region as the emulsion is used. In particular, a light-sensitive element comprising a combination of a blue-sensitive silver halide emulsion and a compound capable of providing a yellow dye, a combination of a green-sensitive silver halide emulsion and a compound capable of providing a magenta dye, and a combination of a red-sensitive silver halide emulsion and a compound capable of providing a cyan dye is useful. As a matter of course, diffusible dye-releasing redox compounds of the present invention can be used as the above-described compounds capable of providing the dye. Each combination of the silver halide emulsion and the dye providing compound may have a multilayer structure in which said silver halide emulsion and said dye providing compound are coated on a support adjacently in face-to-face relationship, or may consist of a single-layer structure in which the silver halides particles and the dye providing compounds dissolved in oil droplets are admixed and coated in the presence of a binder.

A suitable amount of the diffusible dye-releasing redox compounds of the present invention is about 0.01 to about 10, preferably 0.05 to 0.5 mol per mol of the silver halide. A suitable amount of Ag is about 0.1 to 10 g, preferably 0.3 to 4 g per $m^2$ of support.

In a preferred multilayer structure, a blue-sensitive silver halide emulsion layer, a green-sensitive silver halide emulsion layer and a red-sensitive silver halide emulsion layer are positioned in this order from the side of incident light of exposure and, in particular, it is desirable for a yellow filter layer to be positioned between the blue-sensitive silver halide emulsion layer and the green-sensitive silver halide emulsion layer when a highly sensitive silver halide emulsion containing silver iodide is used. The yellow filter layer usually contains a dispersion of yellow colloidal silver, a dispersion of an oil-soluble yellow dye, an acid dye mordanted to a basic polymer or a basic dye mordanted to an acid polymer.

It is advantageous for the silver halide emulsion layers to be separated from each other by an interlayer. The interlayer acts to prevent the occurrence of undesirable interactions between the differently color-sensitized silver halide emulsion layers. The interlayer employed in such a case is usually composed of a hydrophilic polymer such as gelatin, polyacrylamide, a partially hydrolyzed product of polyvinyl acetate, etc., a polymer containing fine pores formed from a latex of a hydrophilic polymer and a hydrophobic polymer, e.g., as described in U.S. Pat. No. 3,625,685, or a polymer whose hydrophilic property is gradually increased by the processing composition, such as calcium alginate, as described in U.S. Pat. No. 3,384,483, individually or as a combination thereof.

Generally speaking, except where noted otherwise, silver halide emulsion layers employed in this invention comprise photosensitive silver halide dispersed in gelatin and are about 0.5 to about 20$\mu$ thick, preferably 0.6 to 6$\mu$, in thick; the dye image providing materials are dispersed in an aqueous alkaline solution-permeable polymeric binder, such as gelatin, as a separate layer about 0.5 to about 20$\mu$ thick, preferably 1 to 7$\mu$ in thick; and the alkaline solution-permeable polymeric interlayers, e.g., gelatin, are about 0.5 to about 20$\mu$ thick, preferably 1 to 5$\mu$ in thick. Of course, these thicknesses are approximate only and can be modified according to the product desired.

The silver halide emulsions which can be used in the present invention are a dispersion of silver chloride, silver bromide, silver chlorobromide, silver iodobromide, silver chloroiodobromide or a mixture thereof in a hydrophilic colloid. The halide composition of the silver halide is selected depending on the purpose of using the photographic materials and the processing conditions for the photographic materials, but a silver iodobromide emulsion or a silver chloroiodobromide emulsion having a halide composition of 1 to 10 mol % iodide, less than 30 mol % chloride, and the rest bromide is particularly preferred. The grain size of the silver halide used may be a conventional grain size or a fine grain size but silver halides having a mean grain size of from about 0.1 micron to about 2 microns are preferred. Furthermore, depending on the specific purpose of using the photographic materials, it is sometimes desirable to use a silver halide having a uniform grain size. The silver halide grains used in the present invention may have the form of a cubic system, an octahedral system, or mixed crystal system thereof. These silver halide emulsions may be prepared using conventional methods as described in, for example, P. Grafkides: Chimie Photographique, Chapters 18–23, 2nd Edition, Paul Montel, Paris (1957).

The silver halide emulsions used in the present invention are preferably chemically sensitized, e.g., by heating using the natural sensitizers contained in gelatin, a sulfur sensitizer such as sodium thiosulfate or N,N,N'-trimethylthiourea, a gold sensitizer such as a thiocyanate complex salt or thiosulfate complex salt of gold, or a reducing sensitizer such as stannous chloride or hexamethylenetetramine.

Also, silver halide emulsions which form a latent image on the surface of the silver halide grains, silver halide emulsions which form a latent image inside the silver halide grains as described in U.S. Pat. Nos. 2,592,550, 3,206,313, etc., and direct positive silver halide emulsions can be used in the present invention.

A suitable coating amount of the emulsion ranges from about 0.1 g/$m^2$ to 10 g/$m^2$, preferably 0.3 g/$m^2$ to 4 g/$m^2$ (silver per $m^2$ of the support). A suitable amount of the dye image-providing material of this invention can range from about 0.01 to about 10 moles, preferably 0.05 to 0.5 mole, per mole of the silver halide.

The silver halide emulsions used in the present invention may be stabilized with additives such as 4-hydroxy-6-methyl-1,3,3a,7-tetrazaindene, 5-nitroimidazole, 1-phenyl-5-merceptotetrazole, 8-chloromercuriquinoline, benzenesulfinic acid, pyrocatechin, 4-methyl-3-sulfoethylthiazolidin-2-thione, 4-phenyl-3-sulfoethylthiazolidin-2-thione, etc., if desired. In addition, inorganic compounds such as cadmium salts, mercury salts, complex salts of platinum group metals such as the chloro complex salt of palladium, and the like are also useful for stabilizing the light-sensitive material of the present invention. Furthermore, the silver halide emulsions used in the present invention may contain sensitizing compounds such as a polyethylene oxide compound.

The silver halide emulsions used in the present invention can possess, if desired, a color sensitivity expanded with a spectral sensitizing dye or dyes. Examples of useful spectral sensitizers are cyanine, merocyanine, holopolar cyanine, styryl, hemicyanine, oxanole, hemioxanole, etc., dyes. Specific examples of suitable spectral sensitizers which can be used in this invention are described in, for example, P. Grafkides, supra, Chapters 35–41, and F. M. Hamer, *The Cyanine Dyes and Related Compounds,* Interscience. A particularly useful spectral sensitizer is a cyanine of which the nitrogen atom of the basic heterocyclic nucleus has been substituted with an aliphatic group (e.g., an alkyl group) having a hydroxy group, a carboxy group, or a sulfo group as described in, for example, U.S. Pat. Nos. 2,503,776, 3,459,553 and 3,177,210.

The dye image providing material used in this invention can be dispersed in a hydrophilic colloid using various techniques, depending on the type of dye image providing material. For example, when the dye image providing material has a dissociable group such as a sulfo group or a carboxy group, the dye image providing material can be added to an aqueous solution of a hydrophilic colloid as a solution in water or as an aqueous alkaline solution thereof. On the other hand, when the dye image providing material is sparingly soluble in aqueous medium but is readily soluble in organic solvents, the dye image providing material is first dissolved in an organic solvent and then the solution is finely dispersed in an aqueous solution of a hydrophilic colloid with stirring. Such a dispersing method is described in detail in, for example, U.S. Pat. Nos. 2,322,027, 2,801,171, 2,949,360 and 3,396,027.

The concentration of the dye image providing materials that are employed in the present invention may be varied over a wide range depending upon the particular compound employed and the results which are desired. For example, the dye image providing compounds of the present invention may be coated in layers by using coating solutions containing about 0.5 to about 15% by weight, preferably containing 0.5 to 8% by weight, of the dye image providing compound distributed in a hydrophilic film forming natural material or synthetic polymer, such as gelatin, polyvinyl alcohol, etc.

To stabilize the dispersion of the dye image providing material and also to promote dye image formation, it is advantageous to incorporate the dye releasing redox compound into an aqueous hydrophilic colloid solution as a solution in a solvent which is substantially insoluble in water and has a boiling point of higher than about 200° C. at normal pressure. Examples of suitable high boiling solvents which can be used for this purpose are aliphatic esters such as the triglycerides of higher fatty acids, dioctyl adipate, etc.; phthalic acid esters such as di-n-butyl phthalate, etc.; phosphoric acid esters such as tri-o-cresyl phosphate, tri-n-hexyl phosphate, etc.; amides such as N,N-diethyllaurylamide, etc.; and hydroxy compounds such as 2,4-di-n-amylphenol. Furthermore, to stabilize the dye image providing material and to promote dye image formation, it is also advantageous to incorporate an oleophilic polymer into the photosensitive layer together with the dye image providing material. Examples of suitable oleophilic polymers which can be used for this purpose are shellac, a phenol-formaldehyde condensate, poly-n-butyl acrylate, a copolymer of n-butyl acrylate and acrylic acid, an interpolymer of n-butyl acrylate, styrene, and methacrylamide, etc.

Such an oleophilic polymer may be dissolved in an organic solvent together with the dye image providing material and then may be dispersed in a photographic hydrophilic colloid such as gelatin as a solution thereof or may be added to a dispersion in a hydrophilic colloid of the dye-releasing redox compound as the hydrosol of a polymer prepared by emulsion polymerization, etc.

The ratio of dye image providing material to polymer can be about 0.1 to about 10, preferably about 0.25 to about 5.

The dispersion of the dye image providing material is generally carried out using a large shearing stress. For instance, a high speed mixer, a colloid mill, a high pressure milk homogenizer, a high pressure homogenizer as described in British Pat. No. 1,304,264, an ultrasonic emulsifying device, etc., are suitably used.

The dispersion of the dye image providing material can be greatly promoted by using a surface active agent as an emulsification aid. Examples of suitable surface active agents useful for dispersion of the dye image providing material used in this invention are sodium triisopropylnaphthalenesulfonate, sodium dinonylnaphthalenesulfonate, sodium p-dodecylbenzenesulfonate, sodium dioctylsulfosuccinate, sodium cetylsulfate, and the anionic surface active agents as described in Japanese Patent Publication No. 4,293/1964 and British Pat. No. 1,138,514. The use of these anionic surface active agents and the higher fatty acid ester of anhydrohexitol exhibits particularly excellent emulsifying capability as disclosed in U.S. Pat. No. 3,676,141. A suitable amount of the surface active agent ranges from about 1% to about 20% by weight per gram of the dye image providing material. Furthermore, the dispersing methods disclosed in Japanese Patent Publication No. 13837/1968 and U.S. Pat. Nos. 2,992,104, 3,044,873, 3,061,428 and 3,832,173 can be effectively employed for dispersing the dye image providing material used in the present invention.

A layer capable of permeating a processing solution, for example, a silver halide emulsion layer, a layer containing a dye releasing redox compound, a subsidiary layer such as a protective layer, an intermediate layer used in the present invention contains a hydrophilic polymer as a binder.

Gelatin is advantageously used as the hydrophilic polymer but other hydrophilic polymers can also be used. For example, a gelatin derivative, a graft polymer of gelatin and another polymer, a protein such as albumin, casein, etc. a cellulose derivative such as hydroxyethylcellulose, carboxymethylcellulose, cellulose sulfate, sodium alginate, a saccharide derivative such as a starch derivative and many kinds of synthetic hydrophilic high molecular weight materials such as a homopolymer or copolymer of polyvinyl alcohol; polyvinyl alcohol partial acetal, poly-N-vinyl pyrrolidone, polyacrylic acid, polymethacrylic acid, polyacrylamide, polyvinyl imidazole, polyvinyl pyrazole, etc., are illustrative.

In addition to alkali treated gelatin, acid treated gelatin, an enzyme treated gelatin as described in *Bull. Soc. Sci. Phot. Japan,* No. 16, Page 30 (1966), a hydrolyzed product of gelatin and a decomposed product of gelatin with enzyme can be used as the gelatin.

Gelatin derivatives which can be used are those which are obtained by reacting gelatin with various kinds of compounds, for example, an acid halide, an acid anhydride, an isocyanate, a bromoacetic acid, an alkanesultone, a vinylsulfonamide, a maleinimide compound, a polyalkylene oxide, an epoxy compound. Specific examples of gelatin derivatives are described in U.S. Pat. Nos. 2,614,928, 3,132,945, 3,186,846 and 3,312,553, British Pat. Nos. 861,414, 1,033,189 and 1,005,784, Japanese Patent Publication No. 26845/1967, etc.

Gelatin graft polymers which can be used are those which are obtained by grafting a polymer or copolymer of vinyl monomers such as acrylic acid, methacrylic acid, or an ester or an amide derivative thereof, acrylonitrile, styrene, etc., to gelatin. Particularly preferred polymers are those compatible with gelatin to some extent, e.g., polymers of acrylic acid, methacrylic acid, acrylamide, methacrylamide, and hydroxyalkyl methacrylates, etc. Examples of these compounds are described in U.S. Pat. Nos. 2,763,625, 2,831,767 and 2,956,884, etc.

Typical synthetic hydrophilic high molecular weight materials are described, for example, in German Patent Application (OLS) No. 2,312,708, U.S. Pat. Nos. 3,620,751 and 3,879,205, Japanese Patent Publication No. 7561/1968, etc.

A silver halide emulsion layer, a layer containing a dye image providing material or other hydrophilic colloid layers used in the photographic light-sensitive sheet of the present invention can contain a coating aid, an inorganic or organic hardener, etc.

As a coating aid, the compounds described in *Product Licensing Index (PLI),* Vol. 92, No. 9232, page 108, XII Coating Aids (December, 1971) can be used.

As a hardener, the compounds described in PLI, Vol. 92, No. 9232, page 108, VII Hardeners can be used.

The light-sensitive sheet of the present invention is prepared by coating directly or indirectly at least one light-sensitive silver halide photographic emulsion layer with the dye image providing material according to the present invention associated therewith onto a substantially planar material which does not undergo large dimensional changes. Examples of suitable supports which can be used are cellulose acetate films, polystyrene films, polyethylene terephthalate films, polycarbonate films, etc., as are used as supports for conventional photographic materials. Other examples of suitable supports are papers and papers coated with a water-impermeable polymer such as polyethlene.

The methods described in Japanese Patent Applications (OPI) Nos. 114424/1974 and 33826/1973 and Belgian Pat. No. 788,268 can be employed as methods of forming diffusion transfer color photographic images by using the dye image providing material of the present invention. These image forming methods can be effectively used with the dye image providing material according to the present invention.

One embodiment of a series of steps for obtaining color diffusion transfer images using a dye image providing material according to the present invention is described below.

(A) A light-sensitive element comprising a support having thereon at least one light-sensitive silver halide emulsion layer with the dye image providing material according to the present invention associated therewith is imagewise exposed.

(B) An alkaline processing composition is spread on the above-described light-sensitive silver halide emulsion layer whereby development of all light-sensitive silver halide emulsion layers in the presence of a developing agent for silver halide is conducted.

(C) As a result, an oxidation product of the developing agent produced in proportion to the amount of exposure cross-oxidizes the dye image providing material.

(D) The above-described oxidation product of the dye image providing material splits to release a diffusible dye.

(E) The released diffusible dye imagewise diffuses to form a transferred image on an image-receiving layer (directly or indirectly) adjacent the light-sensitive silver halide emulsion layer.

In the above-described process, any silver halide developing agents which can cross-oxidize the dye image providing material can be used. These developing agents may be incorporated into the alkaline processing composition or may be incorporated into appropriate photographic layers of the light-sensitive element. Specific examples of suitable developing agents which can be used in this invention are, for example, hydroquinones; aminophenols such as N-methylaminophenol; pyrazolidones such as 1-phenyl-3-pyrazolidone, 1-phenyl-4,4-dimethyl-3-pyrazolidone, 1-phenyl-4-methyl-4-oxymethyl-3-pyrazolidone; phenylenediamines such as N,N-diethyl-p-phenylenediamine, 3-methyl-N,N-diethyl-p-phenylenediamine, 3-methoxy-N-ethoxy-p-phenylenediamine; etc.

Of the above-indicated developing agents, black-and-white developing agents having the capability, in general, of reducing the occurrence of stains in image-receiving layers are particularly preferred in comparison with color developing agents such as phenylenediamines.

When the dye image providing material according to this invention is used, the transferred image formed in the image-receiving layer is a negative image and the image remaining in the photosensitive layer is a positive image where a conventional surface latent image forming type emulsion is used without using a reversal mechanism. On the other hand, where a direct positive silver halide emulsion (including an emulsion which can provide a direct reversal positive image by fogging during development after exposure, for example, an internal latent image forming type silver halide emulsion or a solarization type silver halide emulsion) is employed as the silver halide emulsion in the above-described case, the transferred image formed in the image-receiving layer is a positive image.

Solarization type silver halide emulsions as described in C. E. K. Mees, *The Theory of the Photographic Process,* pages 261–297, Macmillan Co., New York (1942) can be used in this invention. These solarization type silver halide emulsions may be prepared using methods described in, for example, British Pat. Nos. 443,245 and 462,730 and U.S. Pat. Nos. 2,005,837, 2,541,472, 3,367,778, 3,501,305, 3,501,306 and 3,501,307.

Also, internal latent image forming type silver halide emulsions as described in, for example, U.S. Pat. No. 2,592,250, can be advantageously used in this invention. Typical examples of fogging agents which can be used for preparing this type of silver halide emulsion are the hydrazines described in U.S. Pat. Nos. 2,588,982 and 2,563,785, the hydrazide and hydrazone described in U.S. Pat. No. 3,227,552, and the quaternary salt compounds described in British Pat. No. 1,283,835, Japanese Patent Publication No. 38164/1974, and U.S. Pat. Nos. 3,734,738, 3,719,494 and 3,615,615. The amount of fogging agent employed can be widely varied depending upon the results desired. In general, the concentration of fogging agent is from about 0.1 to about 15 g per mole of silver, preferably from about 0.4 to about 10 g per mole of silver in the photosensitive layer in the photosensitive element.

Furthermore, the diffusion inhibitor releasing (DIR) reversal silver halide emulsion system as described in U.S. Pat. Nos. 3,227,551, 3,227,554 and 3,364,022 or the reversal silver halide system using dissolution physical development as described in British Pat. No. 904,364 can be employed in the case of using the dye image providing material of this invention.

It is necessary for the image-receiving element used in this invention in combination with the above-described light-sensitive element to have an image-receiving mordanting layer comprising a mordant, such as the poly-4-vinylpyridine latex (in, preferably, polyvinyl alcohol) described in U.S. Pat. No. 3,148,061, the polyvinyl pyrrolidone described in U.S. Pat. No. 3,003,872, and the polymers containing quaternary ammonium salts as described in U.S. Pat. No. 3,239,337, individually or as a combination thereof. Also, the basic polymers as described in U.S. Pat. Nos. 2,882,156, 3,625,694 and 3,709,690 can be effectively used as the mordant for the image-receiving layer. Other examples of mordants which can be effectively used in this invention are described in U.S. Pat. Nos. 2,484,430, 3,271,147, 3,184,309, etc.

Preferably the light-sensitive sheet of this invention is capable of neutralizing the alkali carried in from the alkaline processing composition. It is advantageous for this purpose for the light-sensitive sheet to include in a cover sheet or in an image-receiving element thereof a neutralizing layer containing an acid material in an amount sufficient to neutralize the alkali in the liquid processing composition, that is, containing an acid material at an area concentration higher than the equivalent of the alkali in the spread liquid processing composition. When a cover sheet having a neutralizing layer is used, the cover sheet can be superimposed on an image-receiving layer after such has been peeled from a light-sensitive element. Typical examples of preferred acid materials which can be used for this purpose are those described in U.S. Pat. Nos. 2,983,606, 2,584,030 and 3,362,819. The neutralizing layer may further contain a polymer such as cellulose nitrate, polyvinyl acetate, etc., and also the plasticizers as described in U.S. Pat. No. 3,557,237 in addition to the acid material. The acid material may be incorporated in the light-sensitive sheet in a microencapsulated form as described in German Patent Application (OLS) No. 2,038,254.

It is desirable for the neutralizing layer or the acid material containing layer which can be used in this invention to be separated from the spread layer of the liquid processing composition by a neutralization rate controlling layer (or timing layer). Gelatin, polyvinyl alcohol, or the compounds described in U.S. Pat. Nos. 3,455,686, 4,009,030 and 3,785,815, Japanese Patent Application (OPI) Nos. 92022/1973, 64435/1974, 22935/1974 and 77333/1976, Japanese Patent Publication Nos. 15756/1969, 12676/1971 and 41214/1973, German Patent Application (OLS) Nos. 1,622,936 and 2,162,227, *Research Disclosure,* No. 151, 15162 (1967), etc., can be effectively used as the timing layer. The timing layer acts to retard the reduction in the pH of the liquid processing composition by the neutralizing layer until the desired development and transfer of dyes can be sufficiently accomplished.

In a preferred embodiment of this invention, the image-receiving element has a multilayer structure comprising a support, a neutralizing layer, a timing layer, and a mordanting layer (or image-receiving layer) in this order. Image-receiving elements are described in detail in, for example, Japanese Patent Application (OPI) No. 13285/1972, U.S. Pat. No. 3,295,970 and British Pat. No. 1,187,502.

The processing composition of the processing element used in this invention is a liquid composition containing the processing components necessary for developing silver halide emulsions and forming diffusion transfer dye images. The solvent of the processing composition is mainly water and contains, as the case may be, a hydrophilic solvent such as methanol, methyl cellosolve, etc. The liquid processing composition contains alkali in an amount sufficient to maintain the necessary pH on developing the silver halide emulsion layers and for neutralizing acids (e.g., hydrohalic acids such as hydrobromic acid, etc., and carboxylic acids such as acetic acid, etc.) formed during development and dye image formation. Examples of suitable alkalis are hydroxides or salts of ammonia, alkali metals or alkaline earth metals or amines, such as lithium hydroxide, sodium hydroxide, potassium hydroxide, an aqueous dispersion of calcium hydroxide, tetramethylammonium hydroxide, sodium carbonate, trisodium phosphate, diethylamine, etc. It is desirable for the liquid processing composition to contain an alkaline material in a concentration such that the pH thereof can be maintained at above about 12, in particular, above 14 at room temperature. Further preferably, the liquid processing composition contains a hydrophilic polymer such as high molecular weight polyvinyl alcohol, hydroxyethyl cellulose, sodium carboxymethyl cellulose, etc. These polymers contribute toward increasing the viscosity of the liquid processing composition above about 1 poise, preferably to 500 or 600 to 1,000 poises, at room temperature, which facilitates the uniform spreading of the processing composition at development as well as the formation of a non-fluid film when the aqueous medium has diffused into the photosensitive element and the image-receiving element during processing thereby concentrating the processing composition, which results in assisting unification of all of the elements after processing. The polymer film also contributes toward preventing coloring components from transferring into the image-receiving layer to stain the dye images formed after the formation of the diffusion transfer dye image is substantially completed.

As the case may be, it is advantageous for the liquid processing composition to further contain a light absorbing material such as $TiO_2$, carbon black, a pH indicating dye, etc., or the desensitizer as described in U.S. Pat. No. 3,579,333 for preventing the silver halide emulsion layers from being fogged by ambient light during processing outside the camera. Furthermore, the liquid processing composition used in this invention may contain a development inhibitor such as benzotriazole.

It is preferred for the above-described processing composition to be retained in a rupturable container as described in U.S. Pat. Nos. 2,543,181, 2,643,886, 2,653,732, 2,723,051, 3,056,491, 3,056,492, 3,152,515, etc.

As the developer, any developer that can cause the oxidation-reduction reaction between exposed silver halide and the DRR compound may be used. For example, ordinary color developers or black-and-white developers are included. Of these, black-and-white developers are particularly preferable. In the case of using a diffusible dye-releasing compound with other dye image-providing materials, all that is required is to use a conventional color developer upon processing in a manner with which the artisan is well acquainted. Where a dye developing agent is used as the dye image providing material, it is not necessary to use other developing agents upon processing. However, it is preferable to use an auxiliary developing agent (e.g., an ordinary black-and-white developing agents).

The light-sensitive film unit of the present invention which has a construction such that after imagewise exposure, the processing of the film unit is performed by passing the film unit through a pair of juxtaposed pressure-applying members comprises:

(1) a support,
(2) a light-sensitive element as described above,
(3) an image-receiving element as described above,
(4) a processing element as described above, and
(5) a developing agent (which can be incorporated into the processing element or the light-sensitive element).

According to one embodiment of the film unit described above, the light-sensitive element and the image-receiving element are superimposed in a face-to-face relationship, and the unit is processed, after exposure, by spreading an alkaline processing composition between both elements. In this case, the image-receiving element may be stripped off after the transfer of the dye images has been completed or the dye images formed in the image-receiving layer may be observed without stripping the image-receiving element as described in U.S. Pat. No. 3,415,645.

In another embodiment of the film unit as described above, the image-receiving element and the light-sensitive element are positioned in this order in the film unit on a support. For example, a suitable photographic film unit is prepared by coating on a transparent support an image-receiving layer, a substantially opaque light reflecting layer (for example, a $TiO_2$-containing layer and a carbon black-containing layer) and a single or a plurality of light-sensitive layers as described above, in this order, as disclosed in Belgian Pat. No. 757,960. After exposing the light-sensitive element, the light-sensitive element is superimposed on an opaque cover sheet in a face-to-face relationship and then a liquid alkaline processing composition is spread between them.

Another embodiment of the superimposed and integral type film unit to which the present invention is most preferably applicable is disclosed in Belgian Pat. No. 757,959. According to this embodiment, the film unit is prepared by coating on a transparent support an image-receiving layer, a substantially opaque light reflective layer (as described above), and a single or a plurality of light-sensitive layers as described above, in this order, and further superimposing a transparent cover sheet on the light-sensitive layer in a face-to-face relationship. A rupturable container retaining an alkaline processing composition having incorporated therein a light-intercepting agent such as, for example, carbon black, is disposed adjacent to and between the uppermost layer of the above-described light-sensitive element and the transparent cover sheet. The film unit is imagewise exposed in a camera through the transparent cover sheet and then the rupturable container retaining the alkaline processing composition is ruptured by the pressure-applying members when the film unit is withdrawn from the camera to spread uniformly the processing composition containing the opacifying agent between the light-sensitive layer and the cover sheet, whereby the film unit is shielded from light and development proceeds.

In these embodiments of film units, the neutralization mechanism as described above is preferably incorporated therein. In particular, the neutralizing layer is preferably positioned in the cover sheet and, further, the timing layer is positioned on the side toward where the processing solution is to be spread, if desired.

Moreover, other useful embodiments of the integral type of film units wherein the dye releasing redox compound of this invention can be used are described in, for example, U.S. Pat. Nos. 3,415,644, 3,415,645, 3,415,646, 3,647,487, and 3,635,707 and German Patent Application (OLS) No. 2,426,980.

The following examples are given to further illustrate the present invention in greater detail.

EXAMPLE 1

20 mg of Dye Compound A represented by the following formula:

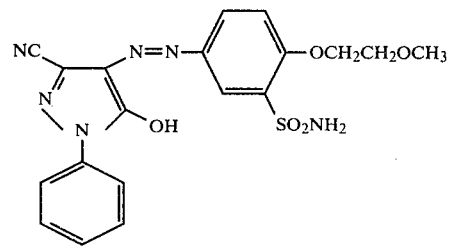

which is released from Compound 1 according to the present invention was dissolved in 5.0 m of a 1/10 N sodium hydroxide aqueous solution. On the other hand, on a polyethylene terephthalate transparent support was coated a mordaning layer containing 3.0 g/m$^2$ of a mordant shown below:

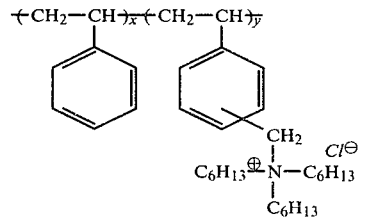

x:y=50:50 (molar ratio) and 3.0 g/m$^2$ of gelatin and the coated film was cut into a strip form to prepare a mordanting strip.

Figure 1:
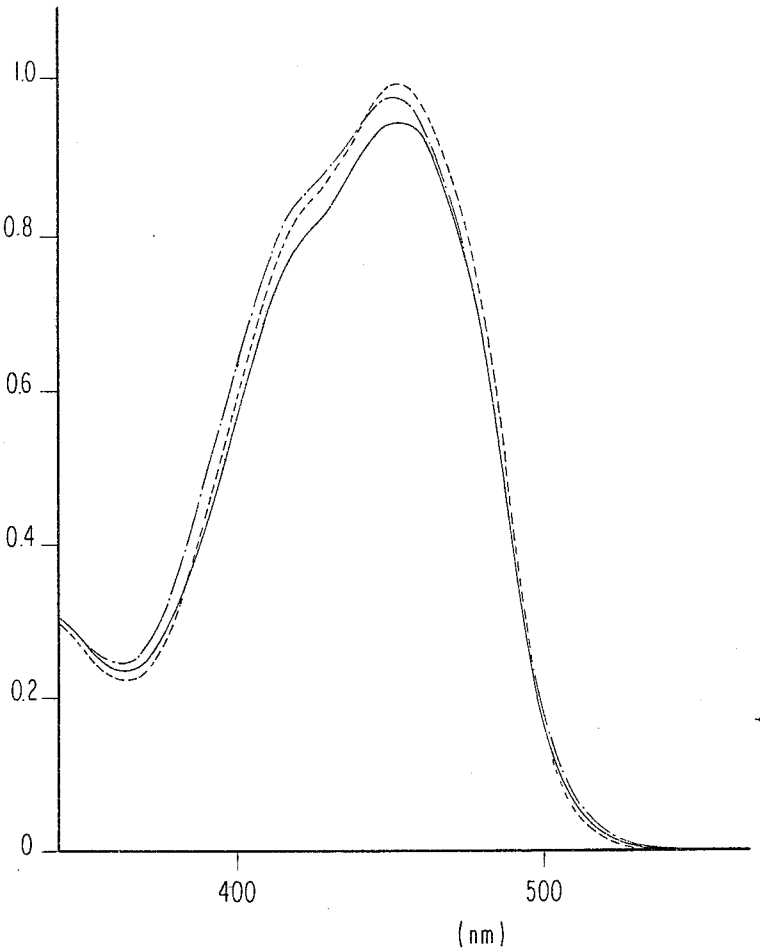

The mordanting strip thus prepared was immersed in the solution of Dye Compound A described above and mordanted to show the absorbance at a maximum absorption wavelength of about 0.5 to about 1.0. The mordanted strip thus obtained was immersed in a buffer solution having different pH and a visible absorption thereof was measured (FIG. 1).

In the same manner described above, using Dye Compound B represented by the following formula:

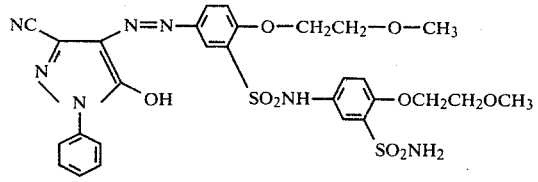

which is released from Compound 15 according to the present invention, a mordanting strip was prepared and a visible absorption was measured at different pH (FIG. 2).

For comparison, a visible absorption was measured at different pH in the same manner described above with respect to Comparison Compounds C and D below:

COMPARISON COMPOUND C

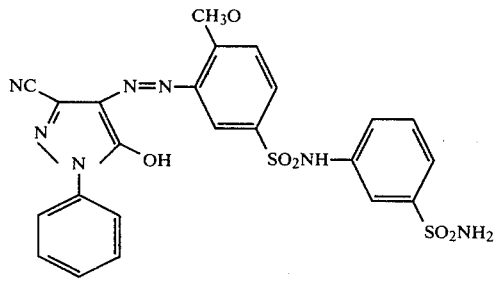

which is released from the compound described in Example 1 of U.S. Pat. No. 4,013,633.

COMPARISON COMPOUND D

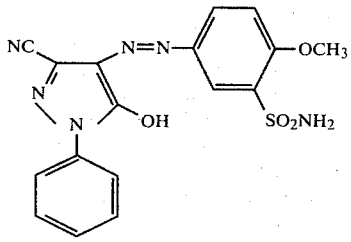

Figure 4:
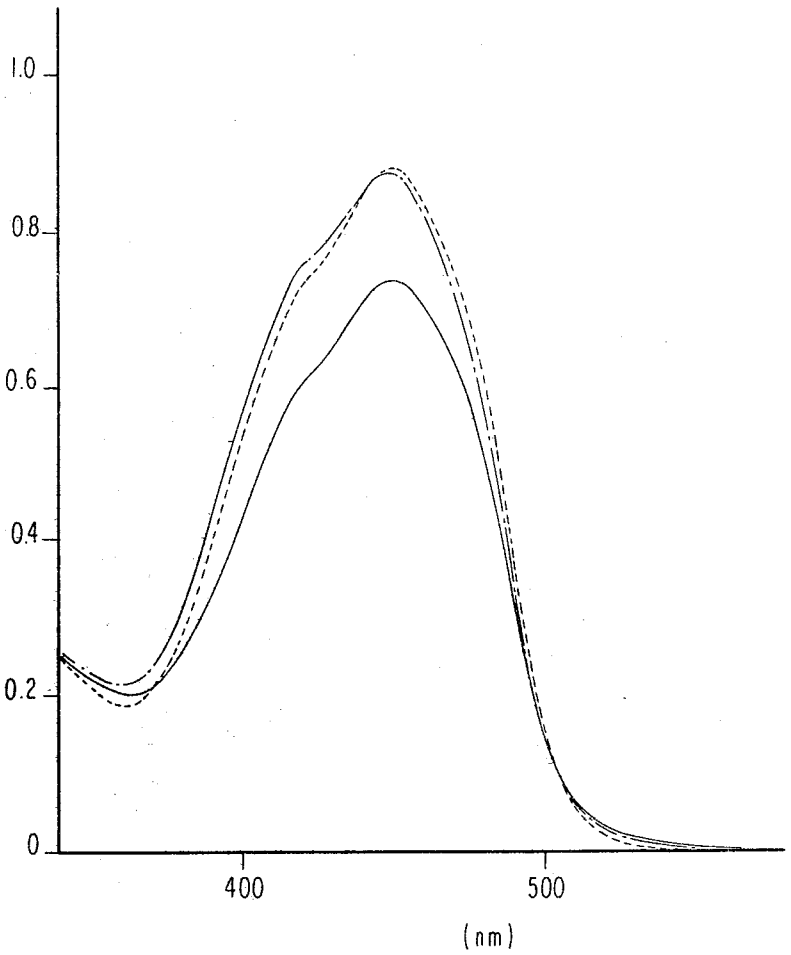
Figure 3:
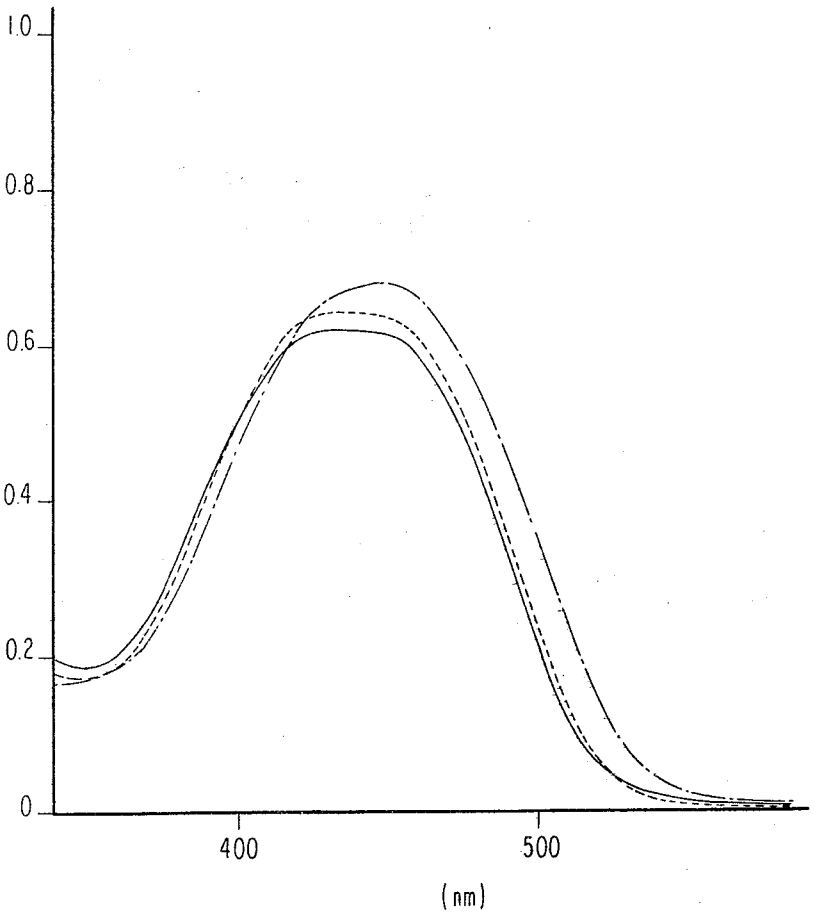

The results thus obtained are shown in FIGS. 3 and 4, respectively.

It is apparent from the results shown in FIGS. 1 and 2 that a visible absorption of the dye compound released from the compound according to the present invention does not substantially vary over a wide range of pH i.e. from about 9.2 to about 4.5. On the contrary, the visible absorption of Comparison Compound C shifts widely to a long wavelength side at a pH below 5. Further a visible absorption of Comparison Compound D varies remarkably at a pH between 9.18 and 6.86.

In a photographic unit for a diffusion transfer process, the pH changes over a wide range such as from a high pH range of about 10 or more just after spreading a processing solution to a low pH range of about 5 or less due to the action of a neutralizing mechanism of an acid polymer layer. Therefore, compounds a visible absorption of which changes in such a pH range, such as the above described Comparison Compounds C and D are not preferred.

The compounds according to the present invention have the advantage that the visible absorption spectra thereof do not substantially change over a wide pH range as shown in Example 1 above.

The difference in effects is believed due to the difference between $CH_3OCH_2CH_2O$—group in Compound A and the $CH_3O$—group in Comparison Compound D. Although there are various hypotheses for such difference, one reason is the presence of an intramolecular hydrogen bond as shown below which suppresses dissociation of the —$SO_2NH$—group.

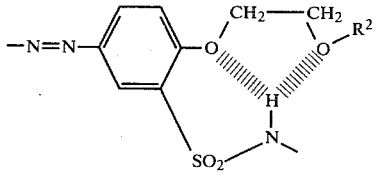

Due to the suppression of dissociation, the change in visible absorption is not substantially observed with respect to Compounds A and B. It is believed that the presence of two oxygen atoms at the positions where an intramolecular hydrogen bond can be formed in $R^2$—O—$R^1$—O— group as described above is meaningfull.

EXAMPLE 2

On a polyethylene terephthalate transparent support were coated the layers described below in the order listed to prepare light-sensitive sheets [A] to [D]. The coating amount of each component is indicated in parenthesis in g/m$^2$ unless otherwise indicated.

(1) Mordanting layer containing a copolymer having the recurring unit described below in the ratio described below:

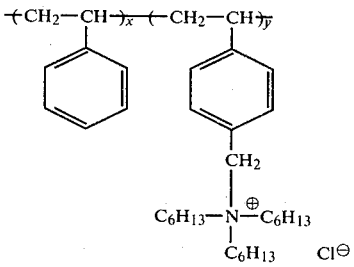

x:y=50:50 (molar ratio) which is described in U.S. Pat. No. 3,898,088 (3.0) and gelatin (3.0).

(2) White light reflective layer containing titanium oxide (20.0) and gelatin (2.0).

(3) Light-shielding layer containing carbon black (2.7) and gelatin (2.7).

(4) Layer containing diethyllaurylamide (0.20), 2,5-di-tert-octylhydroquinone (0.018), gelatin (1.0) and each of the following yellow dye releasing redox compounds:

Light-Sensitive Sheet [A] Compound 1 (0.60 g/m$^2$)
Light-Sensitive Sheet [B] Compound 15 (0.78 g/m$^2$)
Light-Sensitive Sheet [C] Comparison Compound E (0.75 g/m$^2$)

COMPOUND E

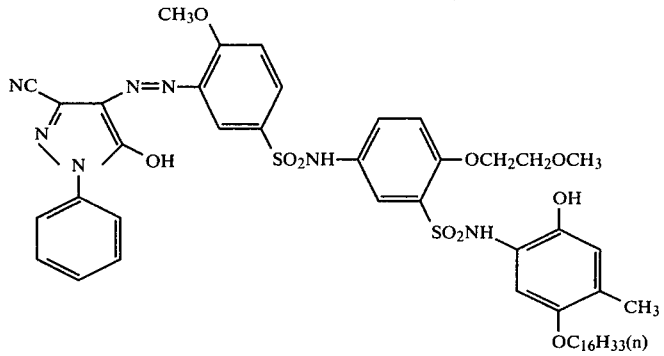

Light-sensitive Sheet [D] Comparison Compound F (0.75 g/m²)

COMPOUND F

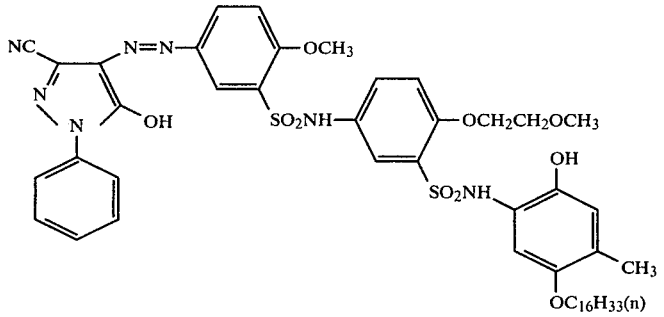

(5) Layer containing a blue-sensitive internal latent image type direct positive silver iodobromide emulsion (composition; silver amount: 1.4 g/m², gelatin: 1.0 g/m², prepared by the method described in U.S. Pat. No. 3,761,276), sodium 5-pentadecylhydroquinone-2-sulfonate (0.11) and 1-formyl-2-{4-[3-(3-phenylthioureido)benzamido]phenyl}hydrazide (11.5 mg per mol of Ag).

(6) Layer containing gelatin (0.70 g/m²)

The above described light-sensitive sheets [A] to [D] and the following elements were associated and subjected to processing.

Processing Solution:

4-Hydroxymethyl-4-methyl-1-phenyl-3-pyrazolidinone: 13 mg
Methylhydroquinone: 0.18 g
5-Methylbenzotriazole: 4 g
Sodium Sulfite (anhydrous): 1 g
Carboxymethyl Cellulose Na Salt: 45 g
Carbon Black: 150 g
Potassium Hydroxide: 56 g
Water to make: 1 kg Cover Sheet:

On a polyethylene terephthalate transparent support were coated the following layers in this order to prepare a cover sheet.

(1) Acid polymer layer containing polyacrylic acid (a 10 wt.% aqueous solution having a viscosity of about 1,000 cp; 15 g/m²).

(2) Neutralization timing layer containing cellulose acetate (degree of acetylation: 39.6 g; 3.8 g/m²) and a styrene maleic anhydride copolymer (composition (molar ratio); styrene: maleic anhydride=about 60:40; molecular weight: about 50,000; 0.2 g/m²).

Processing Step:

The above described cover sheet was superimposed on the above described light-sensitive sheet to form a film unit. Exposure was performed through a color test chart from the cover sheet side. Then, the processing solution described above was spread between both sheets in a thickness of 70 microns (the spreading was performed with assistance of a pair of juxtaposed pressure rollers). The processing was carried out at 25° C. The reflective density of the image formed in the image receiving layer was measured through the support of the light-sensitive sheet using a Macbeth reflective densitometer 2 hours after the processing. The results are shown in Table 1 below.

Measurement of Transferability of Dye

In the same manner as described above, the density of dye transferred in a image receiving layer was measured through the support of the light-sensitive sheet using a Macbeth reflective densitometer 0.5 minute, 1 minute, 2 minutes, 3 minutes, 5 minutes, 10 minutes and 30 minutes after spreading the processing solution between the light-sensitive sheet and the cover sheet, respectively. From the results thus obtained, the times necessary to reach a density of 50% and 80% of the maximum density ($D_{max}$), respectively, were determined. The results are shown in Table 1 below.

Measurement of Light Fastness of Dye Image

In the same manner as described above, the processing solution was spread between the light-sensitive sheet and the cover sheet and the sheets were separated after 2 hours. The light-sensitive sheet was dried and exposed to a light of 17,000 luxes for 7 days using a fluorescent lamp fading tester. The density before exposure and the density after exposure were measured and the latter was divided by the former to determine the remaining ratio. The results thus obtained are shown in Table 1 below.

TABLE 1

| Light-Sensitive Sheet | $D_{max}$ | $D_{min}$ | Transferability (sec.) 50% | 80% | Light Fastness (remaining ratio) | Remarks |
|---|---|---|---|---|---|---|
| A | 1.78 | 0.22 | 48 | 180 | 0.83 | Present Invention |
| B | 1.76 | 0.21 | 69 | 210 | 0.80 | Present Invention |
| C | 1.80 | 0.21 | 87 | 258 | 0.72 | Comparison |
| D | 1.82 | 0.23 | 82 | 245 | 0.82 | " |

It is apparent from the results shown in Table 1 that the transferability of the dye moiety of the dye releasing redox compound according to the present invention is excellent.

EXAMPLE 3

On a polyethylene terephthalate transparent support, the layers described below in the order listed to prepare light-sensitive sheets [E] to [G].

(1) Layer containing a green-sensitive silver iodobromide emulsion (composition; iodide content: 3.5 mol%, silver: 2.4 g/m$^2$, gelatin 1.7 g/m$^2$), diethyllaurylamide (0.20 g/m$^2$), 2.5-di-tert-octylhydroquinone (0.018 g/m$^2$), gelatin (1.0 g/m$^2$) and each of the following yellow dye releasing redox compounds:

Light-Sensitive Sheet [E] Compound 15 (0.78 g/m$^2$)

Light-Sensitive Sheet [F] Comparison Compound E (0.75 g/m$^2$)

Light-Sensitive Sheet [G] Comparison Compound F (0.75 g/m$^2$)

(2) Layer containing gelatin (0.70 g/m$^2$)

The above described light-sensitive sheets [E] to [G] and the following elements were associated and subjected to processing.

| Processing Solution | A | B |
|---|---|---|
| 4-Hydroxymethyl-4-methyl-1-phenyl-3-pyrazolidinone | 13 g | 13 g |
| 5-Methylbenzotriazole | 4 g | 4 g |
| Sodium Sulfite (anhydrous) | 1 g | 1 g |
| Potassium Hydroxide | 56 g | 22.4 g |
| Carboxymethyl Cellulose Na Salt | 60 g | 60 g |
| Water to make | 1 kg | 1 kg |

Image Receiving Sheet:

The mordanting sheet as described in Example 1 was used as an image receiving sheet.

Processing Step:

The above described image receiving sheet was superimposed on the above described light-sensitive sheet and exposed through a color test chart from the image receiving sheet side. The processing solution A or B described above was spread between both sheets in a thickness of 70 microns using a pressure roller. The processing was carried out at 25° C. After 5 minutes the image receiving sheet and the light-sensitive sheet were separated. The light-sensitive sheet was subjected to an after processing comprising stopping, fixing and washing.

The dye image transferred in the image receiving sheet was measured using a Macbeth transmission densitometer. The amount of silver developed in the light-sensitive sheet was measured using a X-ray fluorescent analyzer. From these results thus obtained, the transferred density corresponding to the same amount of developed silver was determined and shown in Table 2 below.

TABLE 2

| Light Sensitive Sheet | Relationship of Amount of Developed Silver and Transferred Dye Density: Processing Solution A Amount of Developed Silver (g/m$^2$) 0.15 | 0.30 | 0.45 | Processing Solution B Amount of Developed Silver (g/m$^2$) 0.15 | 0.30 | 0.45 | Remarks |
|---|---|---|---|---|---|---|---|
| [E] | 0.70 | 0.83 | 0.87 | 0.38 | 0.62 | 0.70 | Present Invention |
| [F] | 0.54 | 0.60 | 0.60 | 0.30 | 0.41 | 0.47 | Comparison |
| [G] | 0.62 | 0.78 | 0.80 | 0.36 | 0.58 | 0.63 | Comparison |

It is apparent from the results shown in Table 2 that the dye releasing redox compound according to the present invention provides a higher transferred density with the same amount of developed silver than the comparison compounds. This means that the higher $D_{max}$ can be obtained using a lesser amount of silver halide.

EXAMPLE 4

On a polyethylene terephthalate transparent support, the layers described below in the order listed to prepare a light-sensitive sheet [H].

(1) Mordanting layer same as described in Example 2.

(2) White light reflective layer same as described in Example 2.

(3) Light-shielding layer same as described in Example 2.

(4) Layer containing a cyan dye releasing redox compound shown below (0.58 g/m$^2$), N,N-diethyllaurylamide (0.13 g/m$^2$), 2,5-di-tert-butylhydroquinone (0.008 g/m$^2$) and gelatin (1.0 g/m$^2$).

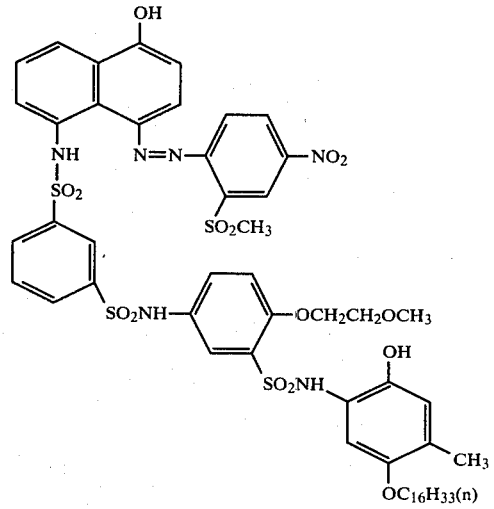

(5) Layer containing a red-sensitive internal latent image type direct positive silver bromide emulsion (silver amount: 1.9 g/m$^2$; gelatin: 1.4 g/m$^2$, prepared by the method described in U.S. Pat. No. 3,716,276), sodium 5-pentadecyl hydroquinone-2-sulfonate (0.13 g/m$^2$) and 1-formyl-2-{4-[3-(3-phenylthioureido)benzamido]-phenyl}hydrazide (18 mg per mol of Ag).

(6) Layer containing gelatin (2.6 g/m$^2$) and 2,5-di-octylhydroquinone (1.0 g/m$^2$).

(7) Layer containing a magenta dye releasing redox compound shown below (0.65 g/m$^2$), diethylenelaurylamide (0.16 g/m$^2$), 2,5-di-tert-butylhydroquinone (0.011 g/m$^2$) and gelatin (1.2 g/m$^2$).

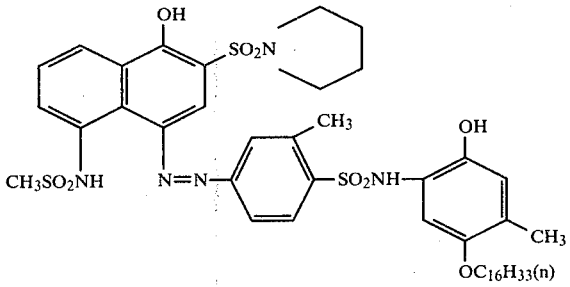

(8) Layer containing a green-sensitive internal latent image type direct positive silver bromide emulsion (silver amount: 1.5 g/m$^2$; gelatin: 1.2 g/m$^2$, prepared by the method described in U.S. Pat. No. 3,716,276); sodium 2-pentadecylhydroquinone-2-sulfonate (0.12 g/m$^2$) and 1-formyl-2-{4-[3-(3-phenylthioureido)-benzamido]-phenyl}hydrazide (15 mg per mol Ag).

(9) Layer same as Layer (6) described above.

(10) Layer same as Layer (4) of Example 2 except containing a yellow dye releasing redox compound shown below.

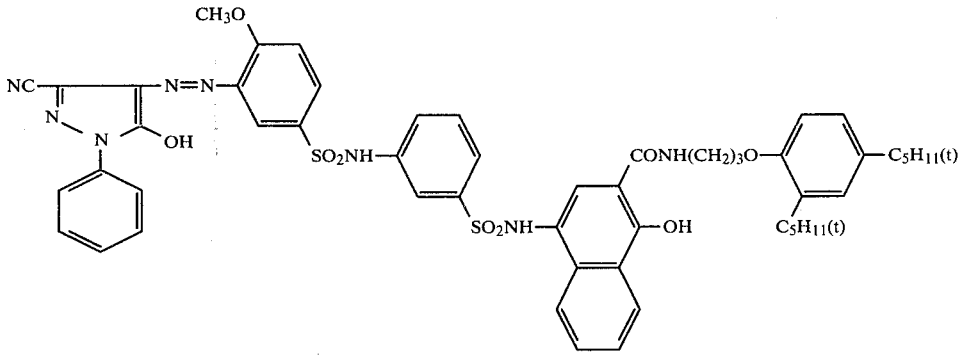

which is described in U.S. Pat. No. 3,928,312.

(11) Layer same as Layer (5) of Example 2.

(12) Layer containing gelatin (0.70 g/m$^2$).

Further, light-sensitive sheets [J], [K], [L] and [M] were prepared in the same manner as described above but using the following compound in place of the yellow dye releasing redox compound in Layer (10) of light-sensitive sheet [H]

| | | |
|---|---|---|
| Light-Sensitive Sheet | (J) | Comparison Compound E (refer to Example 2) |
| Light-Sensitive Sheet | (K) | Comparison Compound F (refer to Example 2) |
| Light-Sensitive Sheet | (L) | Compound 1 |
| Light-Sensitive Sheet | (M) | Compound 9 |

Processing Solution:

Processing solution same as used in Example 2.

Cover Sheet:

On a polyethylene terephthalate transparent support were coated the following layers in this order to prepare a cover sheet.

(1) Acid polymer layer containing a copolymer of acrylic acid and butyl acrylate (composition (molar ratio); acrylic acid: butyl acrylate = about 80:20; average molecular weight: about 50,000; 20 g/m$^2$) and 5-(2-cyanoethylthio)-1-phenyl-tetrazole (0.42 g/m$^2$).

(2) Neutralization timing layer containing cellulose acetate (degree of acetylation: 39.6%; 5.6 g/m$^2$) and a copolymer of styrene and maleic anhydride (composition (molar ratio); styrene: maleic anhydride = about 60:40; 0.36 g/m$^2$).

(3) Layer containing a copolymer of vinylidenechloride, acrylonitrile and acrylic acid (3.3 g/m$^2$).

Processing Step:

The above described cover sheet was superimposed on the above described light-sensitive sheet and exposed through a continuous step wedge from the cover sheet side. Then, the processing solution described above was spread between both sheets in a thickness of 78 microns (the spreading was performed with assistance of a pair of juxtaposed pressure rollers). The pressing was carried out at 25° C. The density of the transferred dye images was measured 2 hours after the processing. Statisfactory dye images were obtained.

Measurement of Transferability of Dye

The transferability of the dye released from the yellow dye releasing redox compound was measured in the same manner as described in Example 2. The results thus obtained are shown in Table 3 below.

TABLE 3

| Light Sensitive Sheet | $D_{max}$* | Time necessary to reach to a density of 50% of $D_{max}$ | | Time necessary to reach to a density of 50% of $D_{max}$ | | Remarks |
|---|---|---|---|---|---|---|
| [H] | 1.82 | 3 min. | 24 sec. | 10 min. | 30 sec. | Comparison |
| [J] | 1.80 | 4 min. | 6 sec. | 12 min. | 7 sec. | Comparison |
| [K] | 1.90 | 3 min. | 39 sec. | 16 min. | 15 sec. | Comparison |
| [L] | 1.84 | 2 min. | 20 sec. | 8 min. | 7 sec. | Present Invention |
| [M] | 1.80 | 2 min. | 5 sec. | 7 min. | 55 sec. | Present Invention |

From the results shown in Table 3 above it is apparent that the transferability of the dye moiety of the dye releasing redox compound according to the present invention is excellent.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive sheet for the color diffusion transfer process which comprises a support having thereon at least one light-sensitive silver halide emulsion layer and at least one of said silver halide emulsion layers having associated therewith a compound represented by the following general formula (I):

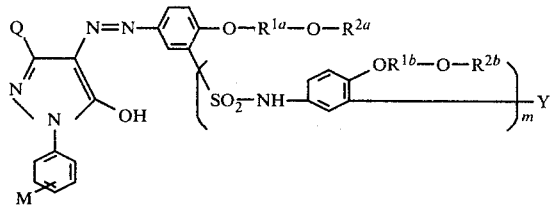

wherein Q represents a cyano group, a trifluoromethyl group or a carbamoyl group represented by the formula $—CONR^3R^3$, wherein $R^3$ represents a hydrogen atom or an alkyl group, $R^4$ represents a hydrogen atom, an alkyl group, an aralkyl group or an aryl group, and $R^3$ and $R^4$ may combine directly or through an oxygen atom to form a ring; M represents a hydrogen atom, a halogen atom, an alkyl group, an alkoxy group, a sulfamoyl group represented by the formula $—SO_2NR^3R^4$ wherein $R^3$ and $R^4$ are as defined above, or a group represented by the formula $—COOR^5$ wherein $R^5$ represents an alkyl group, a phenyl group or a substituted phenyl group; $R^{1a}$ and $R^{1b}$ which may be the same or different, each represents an alkylene group having 2 or more carbon atoms provided that the oxygen atoms in the $—O—R^{1a}—O—R^{2a}$ group are not connected to the same carbon atom in the $R^{1a}$ moiety; $R^{2a}$ and $R^{2b}$, which may be the same or different, each represents an alkly group; Y represents an N-substituted sulfamoyl group, which releases or provides, as a result of development processing under alkaline conditions, an azo dye having a different diffusibility from that of said image-providing material and m represents 0 or 1.

2. The light-sensitive sheet of claim 1 wherein said alkylene group represented by $R^{1a}$ or $R^{1b}$ is an alkylene group having 2 to 8 carbon atoms.

3. The light-sensitive sheet of claim 1 wherein said alkyl group represented by $R^{2a}$ or $R^{2b}$ is an alkyl group having 1 to 8 carbon atoms.

4. The light-sensitive sheet of claim 1 wherein said Q represents a cyano group.

5. The light-sensitive sheet of claim 1 wherein said M represents a hydrogen atom.

6. The light-sensitive sheet of claim 1 wherein said Y is a sulfamoyl group represented by the following formula:

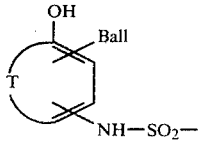

wherein Ball represents a ballast group; T represents the carbon atoms necessary to complete a benzene ring, which may be unsubstituted or substituted, or a naphthalene ring, which may be unsubstituted or substituted; the $NHSO_2$—group is present at the o- or p-position to the hydroxy group; and when T represents the atoms necessary to complete a naphthalene ring, Ball can be bonded to either of the two rings.

7. The light-sensitive sheet of claim 6 wherein said ballast group is or contains a hydrophobic residue having 8 to 32 carbon atoms.

8. The light-sensitive sheet of claim 6, wherein said ballast group is represented by the following formula:

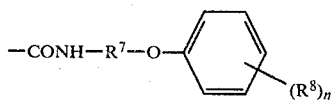

(III)

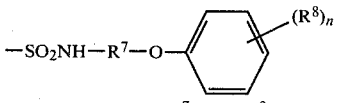

(IIIa)

$—CONH—R^7—O—R^9$ (IV)

$—O—R^{10}$ (V)

(Va)

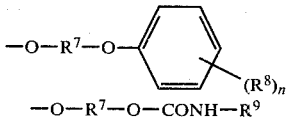

$—O—R^7—O—CONH—R^9$ (Vb)

$—O—R^7—O—R^9$ (Vc)

$—CONHR^9$ (VI)

wherein $R^7$ represents an alkylene group having 1 to 10 carbon atoms or an arylene group having 6 to 30 carbon atoms; $R^8$ represents a hydrogen atom or an alkyl group having 1 to 30 carbon atoms; n represents an integer of 1 to 5, $R^9$ represents an alkyl group having 4 to 30 carbon atoms or a group represented by the formula

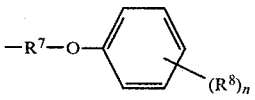

where $R^7$, $R^8$ and n have the same meaning as defined above and $R^{10}$ represents an alkyl group having 8 to 30 carbon atoms.

9. The light-sensitive sheet of claim 6 wherein $R^{1a}$ and $R^{1b}$ each represents a $—CH_2CH_2$—group; $R^{2a}$ and $R^{2b}$, which may be the same or different, each represents a straight chain or branched chain alkyl group having 1 to 4 carbon atoms; Q represents a cyano group; M represents a hydrogen atom; and m represents 0 or 1.

10. The light-sensitive sheet of claim 1 wherein $R^{1a}$ is a $—CH_2CH_2$—group; $R^{2a}$ represents a straight chain alkyl group having 1 to 4 carbon atoms; Q represents a cyano group; M represents a hydrogen atom; m represents O; and Y represents an o-hydroxyphenylsulfamoyl group having an alkyl group at the meta position to the hydroxy group and additionally a ballast group.

11. The light-sensitive sheet of claim 1 wherein the dye releasing redox compoiund represented by the general formula (I) is selected from the group consisting of

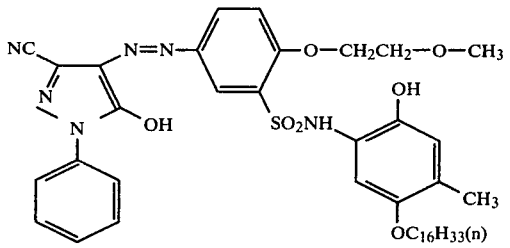
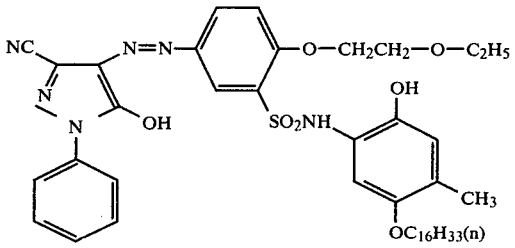
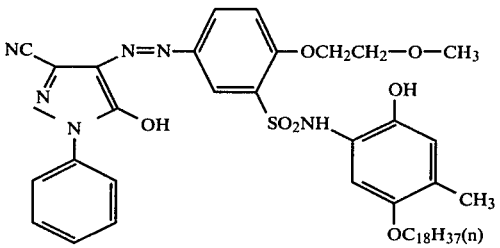
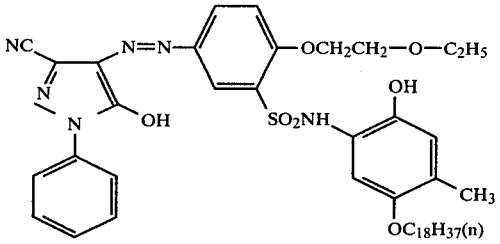
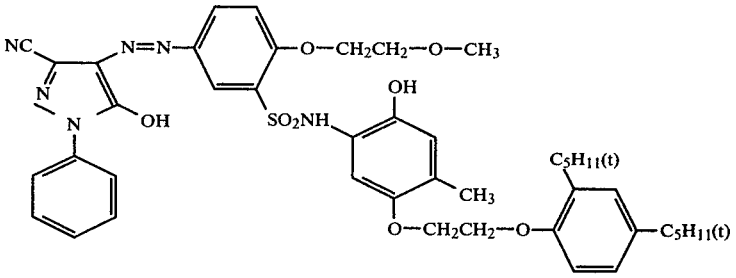
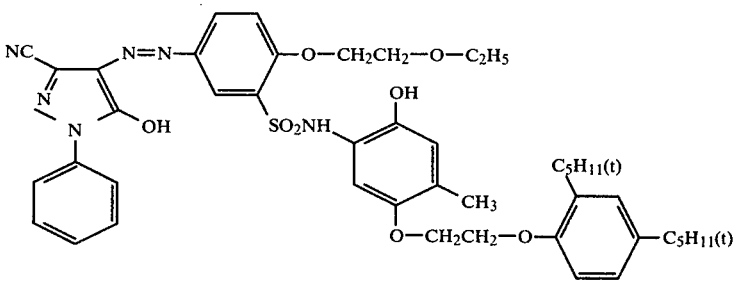

-continued
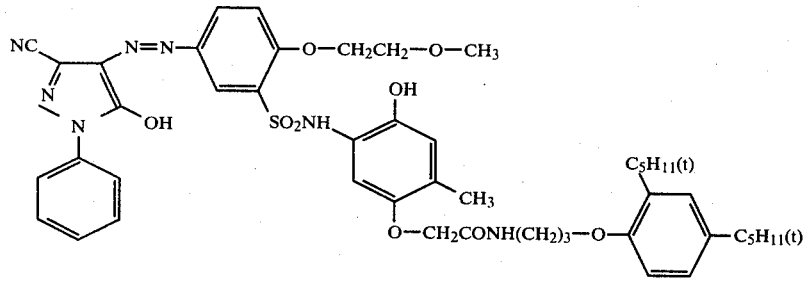
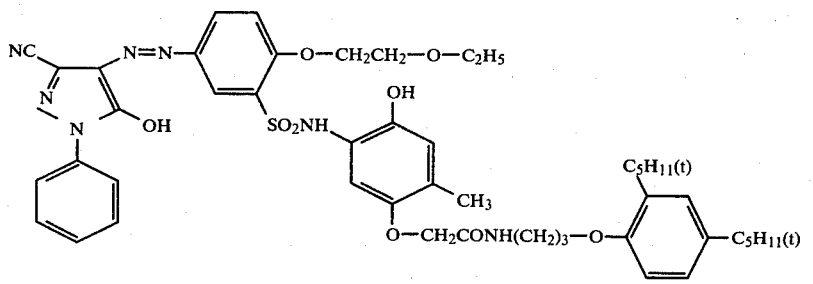
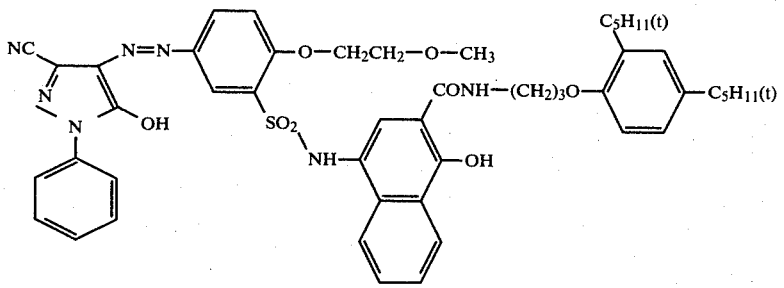
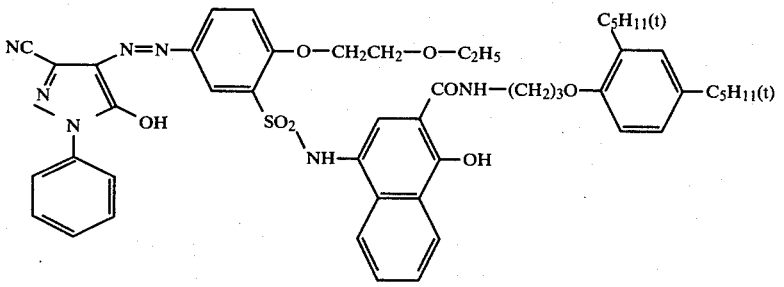
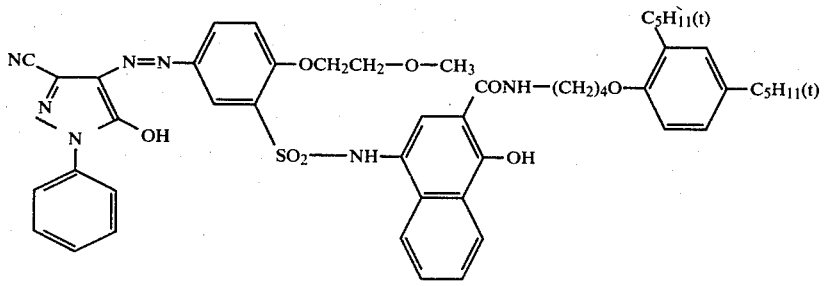

-continued
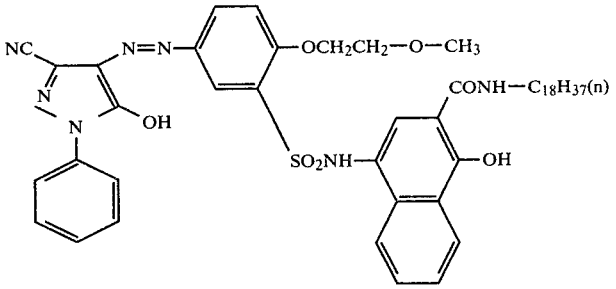
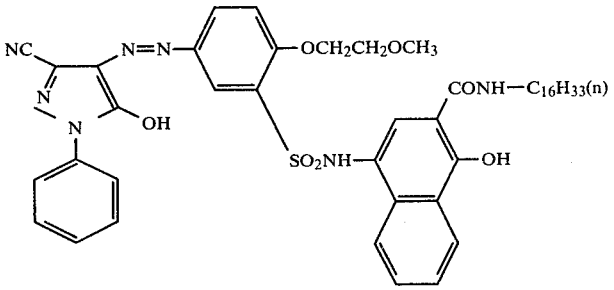
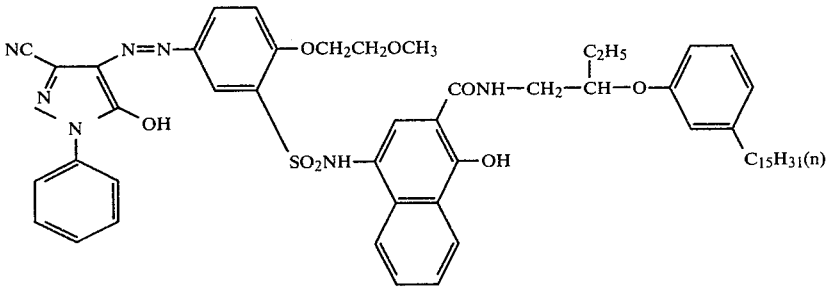
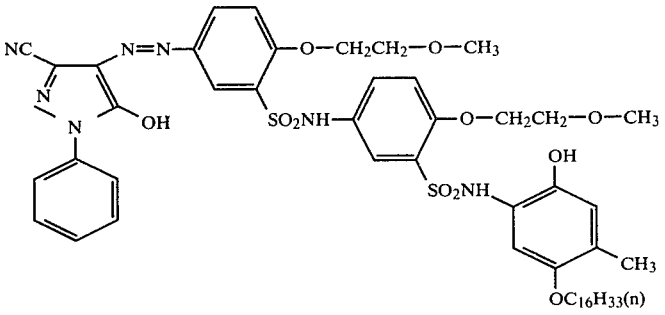
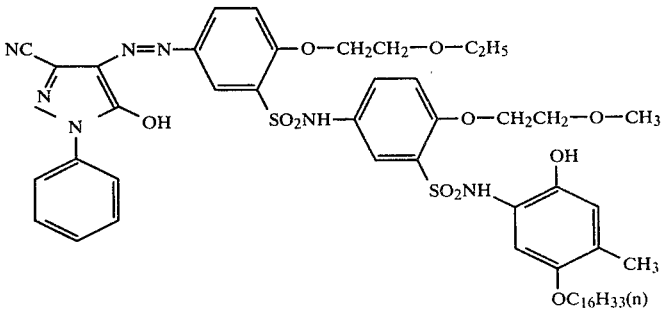

-continued
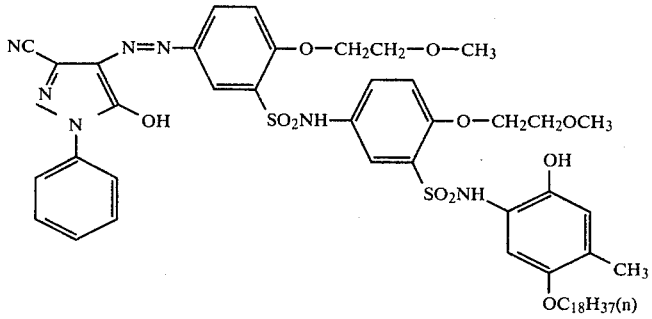
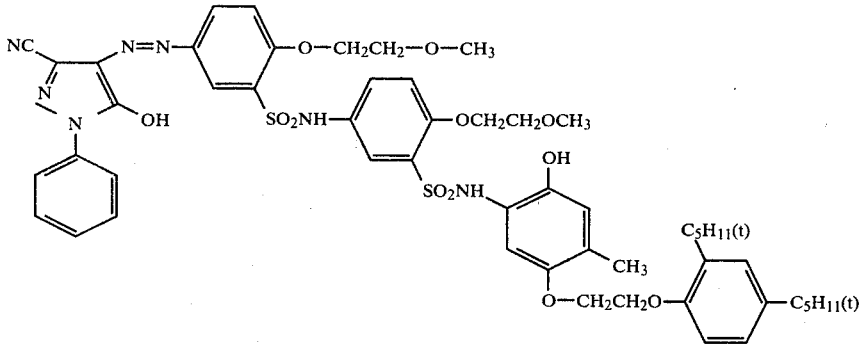
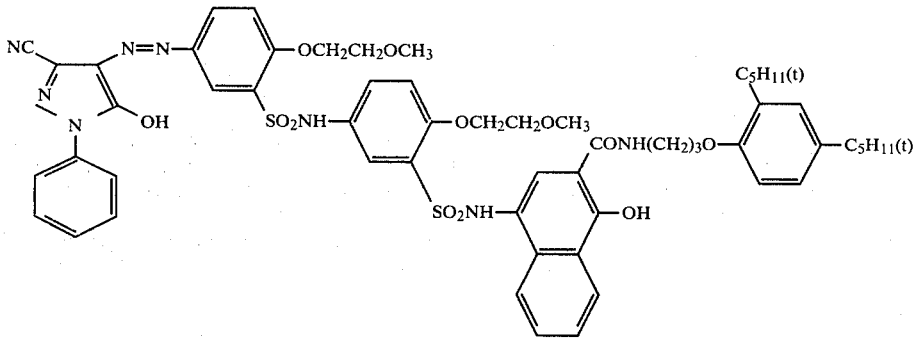
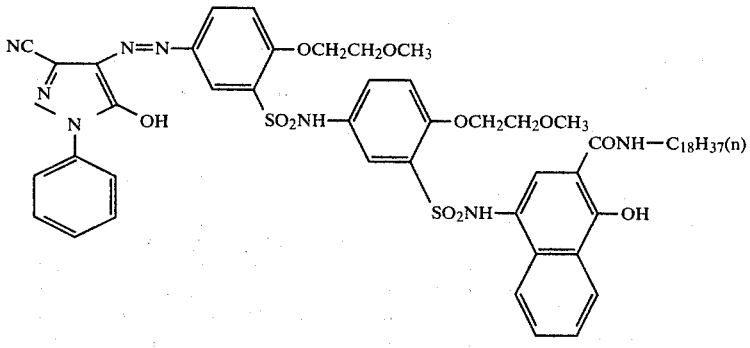
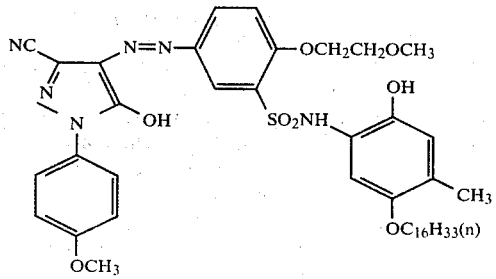

-continued

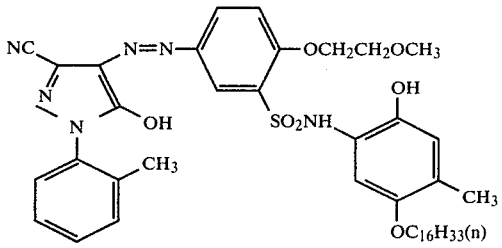

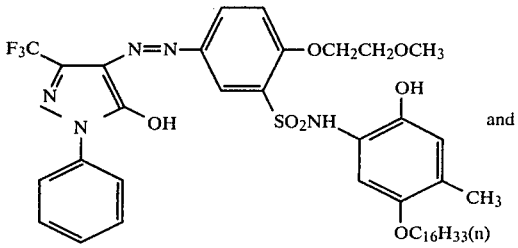

and

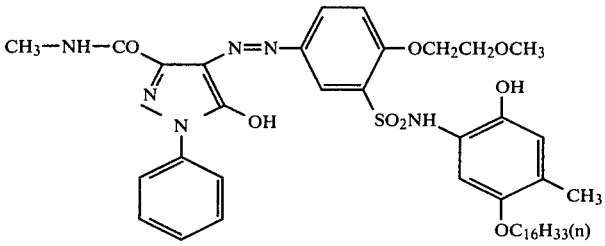

12. The light-sensitive sheet of claim 1 wherein the light-sensitive sheet contains a combination a silver halide emulsion layer and the dye releasing redox compound represented by the general formula (I) wherein the silver halide emulsion layer and the compound represented by the general formula (I) are coated on the support in separate but contiguous layers.

13. The light-sensitive sheet of claim 1 wherein the light-sensitive sheet contains a combination of a silver halide emulsion layer and a dye releasing redox compound represented by the general formula (I) wherein the dye releasing redox compound is incorporated in the silver halide emulsion layer.

14. The light-sensitive sheet of claim 1 wherein said support has thereon a blue sensitive silver halide emulsion layer, a green-sensitive silver halide emulsion layer and a red-sensitive silver halide emulsion layer, and wherein said silver halide emulsion layers are associated with a dye providing compound respectively, and the blue-sensitive silver halide emulsion layer is associated with the compound represented by the general formula (I).

15. The light-sensitive sheet of claim 1, wherein said silver halide emulsion is an internal latent image type silver halide emulsion.

16. The light-sensitive sheet of claim 1, wherein said alkylene group represented by $R^{1a}$ and $R^{1b}$ is a straight chain alkylene group having 1 to 4 carbon atoms.

17. The light-sensitive sheet of claim 1, wherein said alkylene group represented by $R^{1a}$ and $R^{1b}$ is $—CH_2—CH_2—$.

18. The light-sensitive sheet of claim 1, wherein said alkyl group represented by $R^{2a}$ and $R^{2b}$ is a methyl group or an ethyl group.

19. In a photographic film unit for the color diffusion transfer process which comprises a light-sensitive element, an image receiving element, a processing element and a developing agent, the improvement which comprises said light-sensitive element comprising a support having thereon at least one light-sensitive silver halide emulsion layer and at least one of said silver halide emulsion layers having associated therewith a compound represented by the following general formula (I):

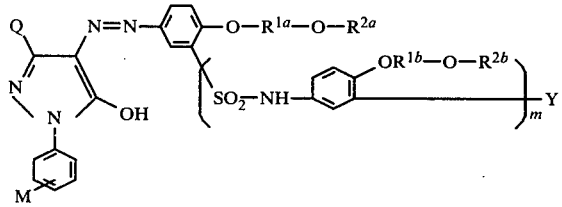

wherein Q represents a cyano group, a trifluoromethyl group or a carbamoyl group represented by the formula $—CONR^3R^4$ wherein $R^3$ represents a hydrogen atom or an alkyl group, $R^4$ represents a hydrogen atom, an alkyl group, an aralkyl group or an aryl group, and $R^3$ and $R^4$ may combine directly or through an oxygen atom to form a ring; M represents a hydrogen atom, a halogen atom, an alkyl group, an alkoxy group, a sulfamoyl group represented by the formula $—SO_2NR^3R^4$ wherein $R^3$ and $R^4$ are as defined above, or a group represented by the formula $—COOR^5$ wherein $R^5$ represents an alkyl group, a phenyl group or a substituted phenyl group; $R^{1a}$ and $R^{1b}$, which may be the same or different, each represents an alkylene group having 2 or more carbon atoms provided that the oxygen atoms in the $—O—R^{1a}—O—R^{2a}$ group are not connected to the same carbon atom in the $R^{1a}$ moiety; $R^{2a}$ and $R^{2b}$, which may be the same or different, each represents an alkyl group; Y represents an N-substituted sulfamoyl group, which releases or provides, as a result of development processing under alkaline conditions, an azo dye having a different diffusibility from that of said image-providing material; and m represent 0 or 1.

20. The photographic film unit of claim 19 wherein said alkyl group represented by $R^{2a}$ or $R^{2b}$ is an alkyl group having 2 to 8 carbon atoms.

21. The photographic film unit of claim 19 wherein said alkyl group represented by $R^{2a}$ or $R^{2b}$ is an alkyl group having 1 to 8 carbon atoms.

22. The photographic film unit of claim 19 wherein said Q represents a cyano group.

23. The photographic film unit of claim 19 wherein said M represents a hydrogen atom.

24. The photographic film unit of claim 19 wherein said Y is a sulfamoyl group represented by the following formula:

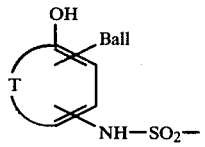

wherein Ball represents a ballast group; T represents the carbon atoms necessary to complete a benzene ring, which may be unsubstituted or substituted, or a naphthalene ring, which may be unsubstituted or substituted; the $NHSO_2$— group is present at the o- or p-position to the hydroxy group; and when T represents the atoms necessary to complete a naphthalene ring, Ball can be bonded to either of the two rings.

25. The photographic film unit of claim 24 wherein said ballast group is or contains a hydrophobic residue having 8 to 32 carbon atoms.

26. The photographic film unit of claim 24 wherein said ballast group is represented by the following formula:

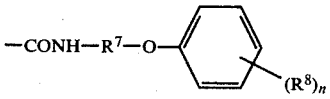

(III)

-continued

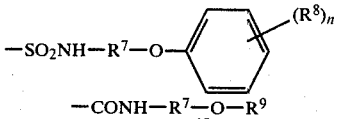

(IIIa)

—CONH—$R^7$—O—$R^9$ (IV)

—O—$R^{10}$ (V)

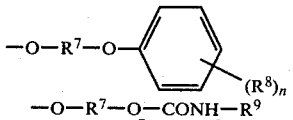

(Va)

—O—$R^7$—O—CONH—$R^9$ (Vb)

—O—$R^7$—O—$R^9$ (Vc)

—CONH$R^9$ (VI)

wherein $R^7$ represents an alkylene group having 1 to 10 carbon atoms or an arylene group having 6 to 30 carbon atoms; $R^8$ represents a hydrogen atom or an alkyl group having 1 to 30 carbon atoms; n represents an integer of 1 to 5, $R^9$ represents an alkyl group having 4 to 30 carbon atoms or a group represented by the formula

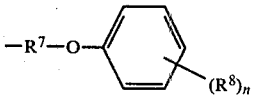

where $R^7$, $R^8$ and n have the same meaning as defined above, and $R^{10}$ represents an alkyl group having 8 to 30 carbon atoms.

27. The photographic film unit of claim 24 wherein $R^{1a}$ and $R^{1b}$ each represents a —$CH_2CH_2$— group; $R^{2a}$ and $R^{2b}$, which may be the same or different, each represents a straight chain or branched chain alkyl group having 1 to 4 carbon atoms; Q represents a cyano group; M represents a hydrogen atom; and m represents 0 or 1.

28. The photographic film unit of claim 19 wherein $R^{1a}$ is a —$CH_2CH_2$— group; $R^{2a}$ represents a straight chain alkyl group having 1 to 4 carbon atoms; Q represents a cyano group; M represents a hydrogen atom; m represents O; and Y represents an o-hydroxyphenylsulfamoyl group having an alkyl group at the meta position to the hydroxy group and additionally a ballast group.

29. The photographic film unit of claim 19 wherein the dye releasing redox compound represented by the general formula (I) is selected from the group consisting of

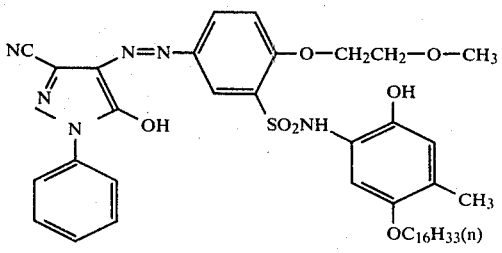

-continued
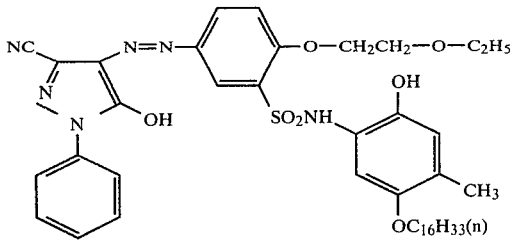
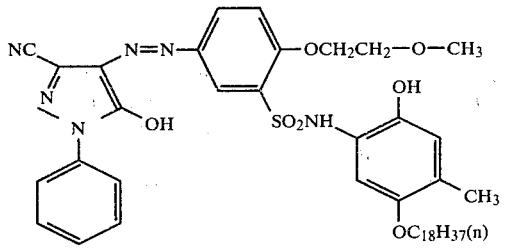
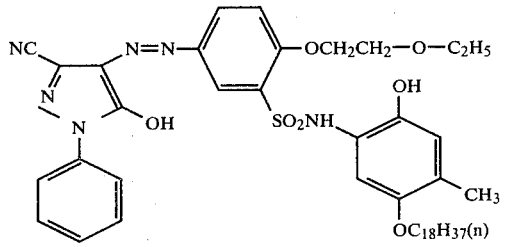
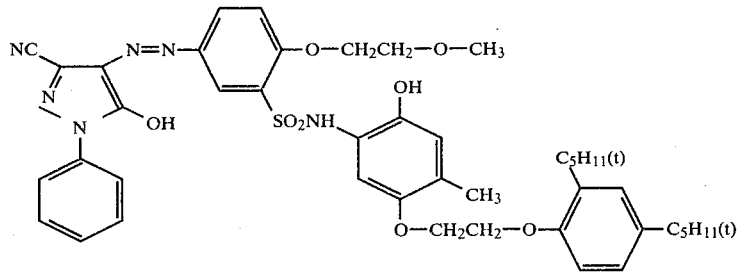
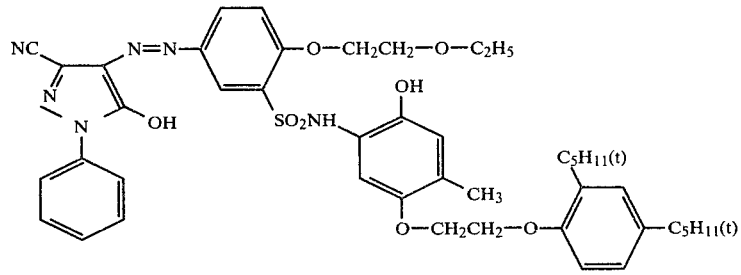
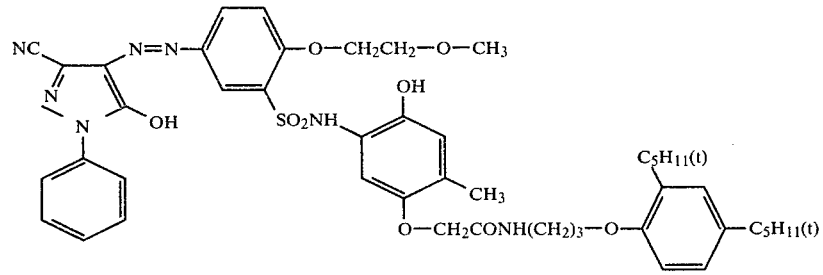

-continued
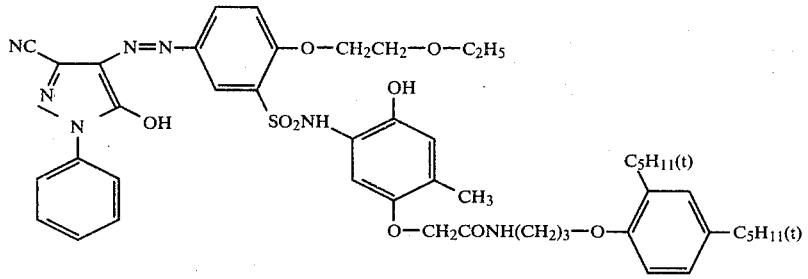
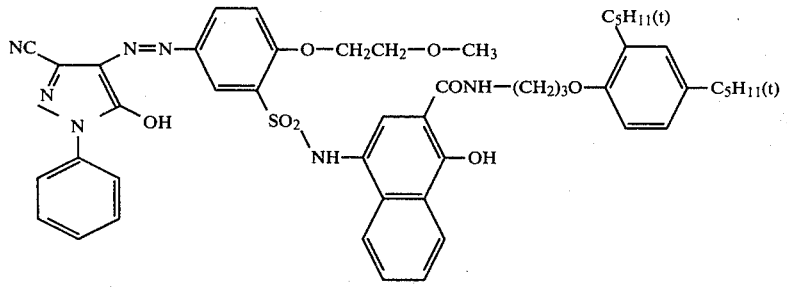
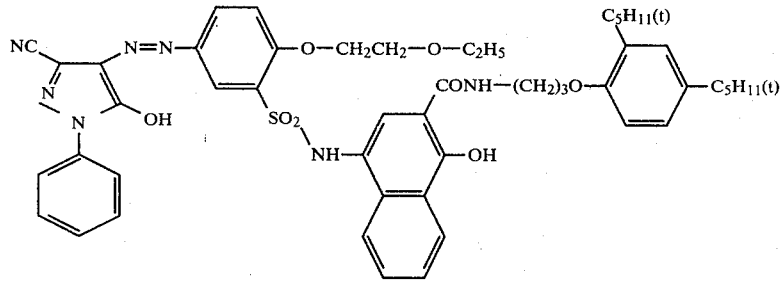
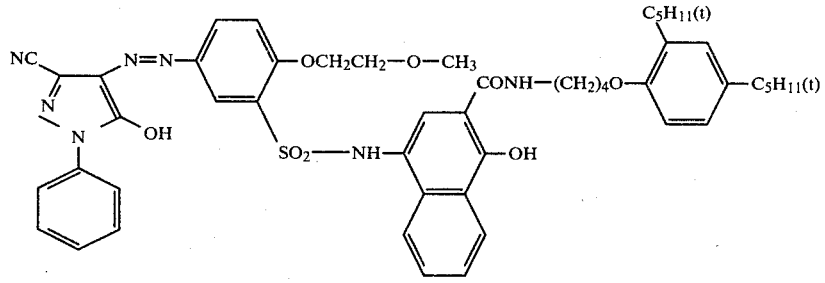
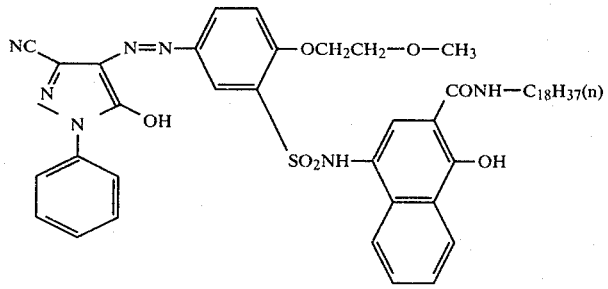

-continued
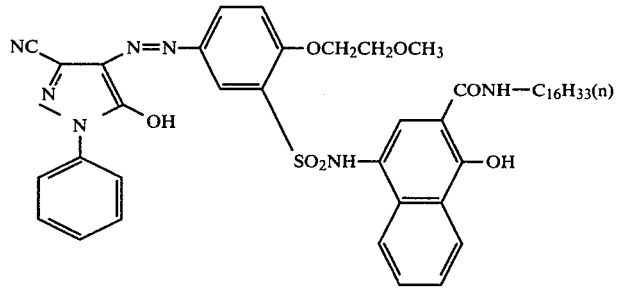
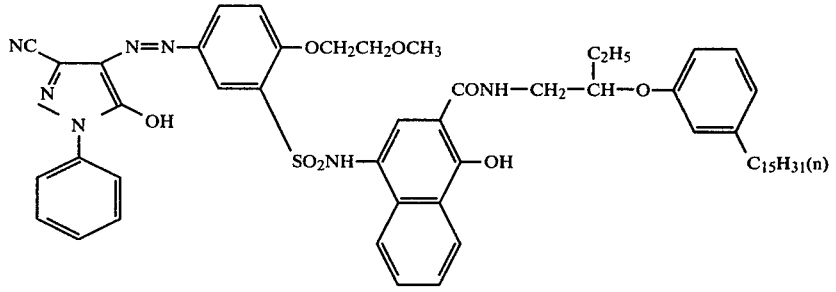
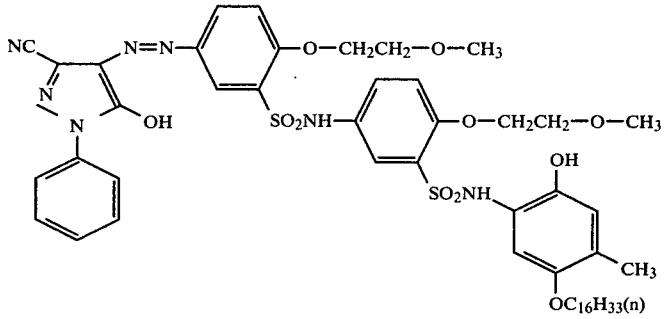
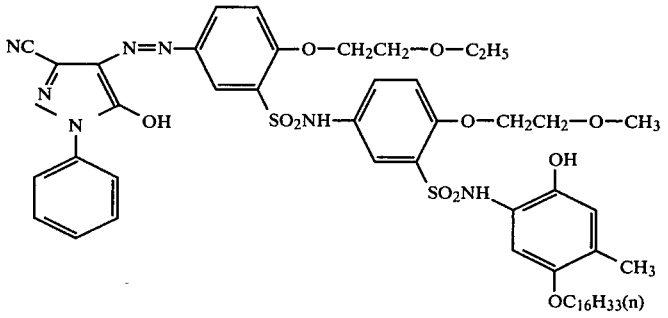
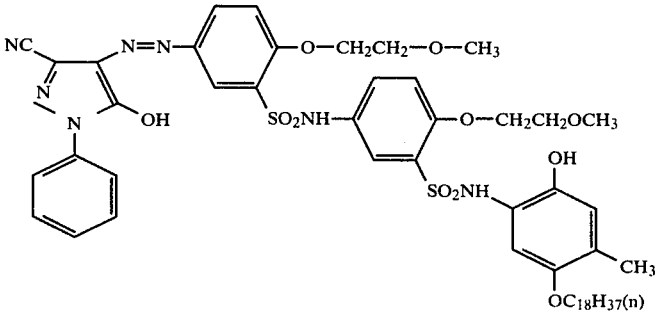

-continued
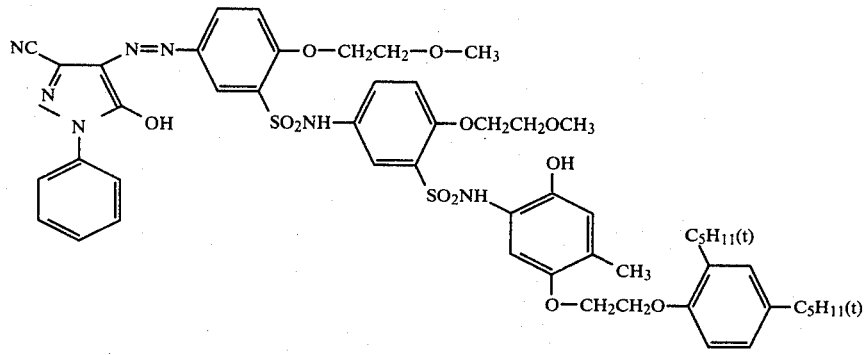
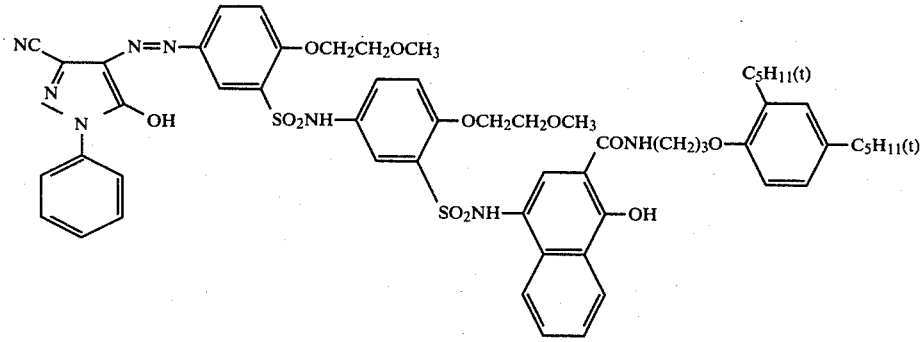
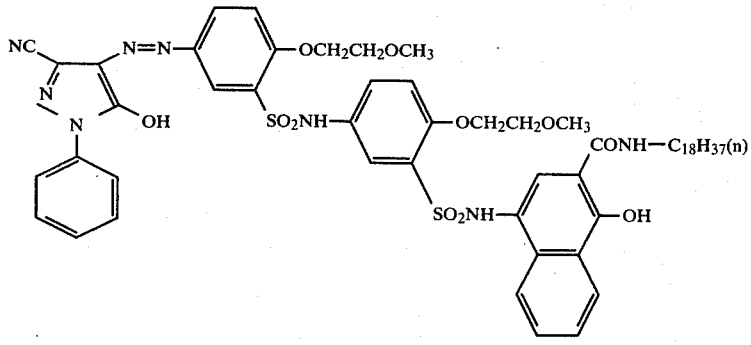
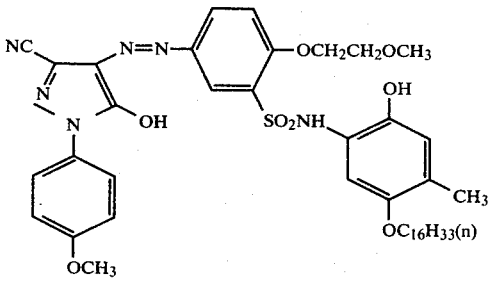
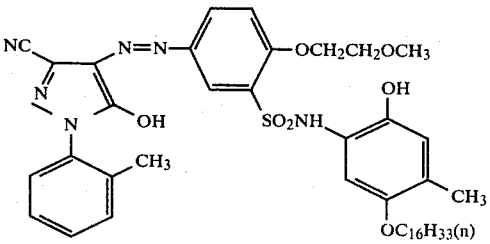

-continued

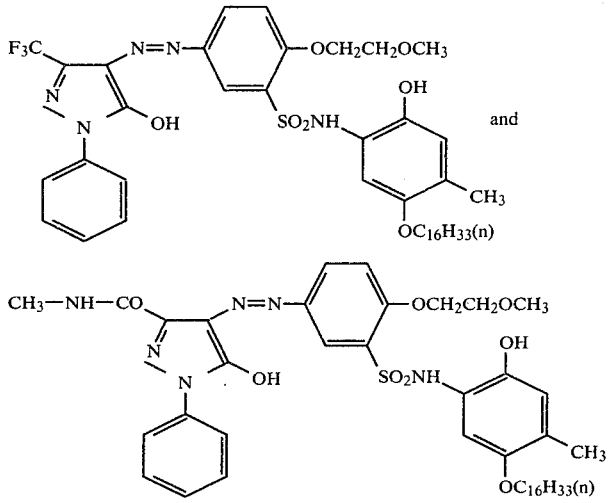

30. The photographic film unit of claim 19 wherein the light-sensitive sheet contains a combination of a silver halide emulsion layer and the dye releasing redox compound represented by the general formula (I) wherein the silver halide emulsion layer and the compound represented by the general formula (I) are coated on the support in separate, but contiguous, layers.

31. The photographic film unit of claim 19 wherein the light-sensitive sheet contains a combination of a silver halide emulsion layer and a dye releasing redox compound represented by the general formula (I) wherein the dye releasing redox compound is incorporated in the silver halide emulsion layer.

32. The photographic film unit of claim 19 wherein said support has thereon a blue sensitive silver halide emulsion layer, a green-sensitive silver halide emulsion layer and a red-sensitive silver halide emulsion layer, and said emulsion layers are associated with a dye providing compound respectively and the blue-sensitive silver halide emulsion layer is associated with the compound represented by the general formula (I).

33. The photographic film unit of claim 19 wherein said silver halide emulsion is an internal latent image type silver halide emulsion.

34. The photographic film unit of claim 19 wherein said alkylene group represented by $R^{1a}$ and $R^{1b}$ is a straight chain alkylene group having 1 to 4 carbon atoms.

35. The photographic film unit of claim 19 wherein said alkylene group represented by $R^{1a}$ and $R^{1b}$ is —$CH_2$—$CH_2$—.

36. The photographic film unit of claim 19 wherein said alkyl group represented by $R^{2a}$ and $R^{2b}$ is a methyl group or an ethyl group.

37. The light-sensitive sheet of claim 1, wherein the substituent on the N-atom of said N-substituted sulfamoyl group is a carbocyclic ring group.

38. The light-sensitive sheet of claim 37, wherein said N-substituted sulfamoyl group is a group represented by the following formula (A), (B) or (E)

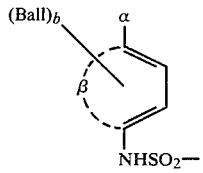

(A)

wherein $\beta$ represents the non-metallic atoms necessary to complete a benzene ring, with which a carbocyclic ring or a heterocyclic ring may be fused, $\alpha$ represents an —OG′ or —$NHG^2$ group, wherein G′ represents a hydrogen atom or a group capable of forming a hydroxyl group by hydrolysis, $G^2$ represents a hydrogen atom, an alkyl group having 1 to 22 carbon atoms or a hydrolyzable group, b is an integer of 0, 1 or 2, and Ball represents a ballast group;

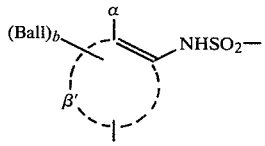

(B)

wherein Ball, $\alpha$ and b are the same as defined above for formula (A), and $\beta'$ represents the atoms necessary to form a carbocyclic ring, with which a carbocyclic ring or a heterocyclic ring may be fused;

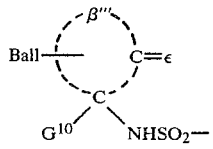

(E)

wherein Ball is the same as defined above for formula (A), $\epsilon$ represents an oxygen atom or —NG″ wherein G″ represents a hydroxyl group or an amino group, $\beta'''$ represents with the carbon atoms shown a 5-, 6- or 7-membered saturated or unsaturated non-aromatic hydrocarbon ring, and $G^{10}$ represents a hydrogen atom or a halogen atom.

39. The light-sensitive sheet of claim 1, wherein the substituent on the N-atom of said N-substituted sulfamoyl group is a heterocyclic ring group.

40. The light-sensitive sheet of claim 39, wherein said N-substituted sulfamoyl group is a group represented by the following formula (C) or (D)

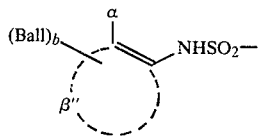

(C)

wherein α represents an —OG' or —NHG² group, wherein G' represents a hydrogen atom or a group capable of forming a hydroxyl group by hydrolysis, G² represents a hydrogen atom, an alkyl group having 1 to 22 carbon atoms or a hydrolyzable group, b is an integer of 0, 1 or 2, and Ball represents a ballast group, β'' represents the atoms necessary for forming a heterocyclic ring, with which a carbocyclic ring or a heterocyclic ring may further be fused;

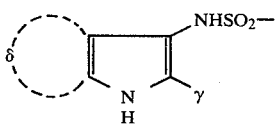

(D)

wherein γ represents a hydrogen atom, an alkyl group, an aryl group, a heterocyclic ring group, or —CO—G⁶ wherein G⁶ represents —OG⁷, —S—G⁷ or

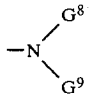

wherein G⁷ represents a hydrogen atom, an alkyl group, a cycloalkyl group or an aryl group, G⁸ has the same meaning as G⁷ and additionally represents an acyl group, G⁹ represents a hydrogen atom or a substituted or unsubstituted alkyl group, δ represents the atoms necessary for completing a fused benzene ring and γ and/or the substituents on said fused benzene ring completed by δ is a ballast group or a ballast-containing group.

41. The photographic film unit of claim 19, wherein the substituent on the N-atom of said N-substituted sulfamoyl group is a carbocyclic ring group.

42. The photographic film unit of claim 41, wherein said N-substituted sulfamoyl group is a group represented by the following formula (A), (B) or (E)

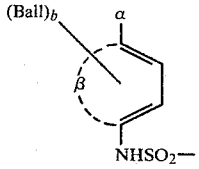

(A)

wherein β represents the non-metallic atoms necessary to complete a benzene ring, with which a carbocyclic ring or a heterocyclic ring may be fused, α represents an —OG' or —NHG² group, wherein G' represents a hydrogen atom or a group capable of forming a hydroxyl group by hydrolysis, G² represents a hydrogen atom, an alkyl group having 1 to 22 carbon atoms or a hydrolyzable group, b is an integer of 0, 1 or 2, and Ball represents a ballast group;

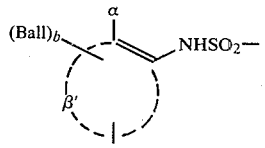

(B)

wherein Ball, α and b are the same as defined above for formula (A), and β' represents the atoms necessary to form a carbocyclic ring, with which a carbocyclic ring or a heterocyclic ring may be fused;

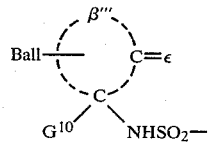

(E)

wherein Ball is the same as defined above for formula (A), ε represents an oxygen atom or —NG'' wherein G'' represents a hydroxyl group or an amino group, β''' represents with the carbon atoms shown a 5-, 6- or 7-membered saturated or unsaturated non-aromatic hydrocarbon ring, and G¹⁰ represents a hydrogen atom or a halogen atom.

43. The photographic film unit of claim 19, wherein the substituent of the N-atom of said N-substituted sulfamoyl group is a heterocyclic ring group.

44. The photographic film unit of claim 43, wherein said N-substituted sulfamoxyl group is a group represented by the following formula (C) or (D)

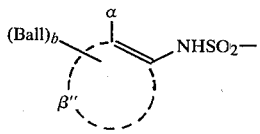

(C)

wherein α represents an —OG' or —NHG² group, wherein G' represents a hydrogen atom or a group capable of forming a hydroxyl group by hydrolysis, G² represents a hydrogen atom, an alkyl group having 1 to 22 carbon atoms or a hydrolyzable group, b is an integer of 0, 1 or 2, and Ball represents a ballast group, β'' represents the atoms necessary for forming a heterocyclic ring, with which a carbocyclic ring or a heterocyclic ring may further be fused;

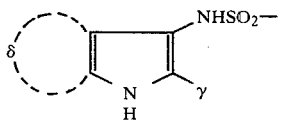

(D)

wherein γ represents a hydrogen atom, an alkyl group, an aryl group, a heterocyclic ring group, or —CO—G⁶ wherein G⁶ represents —OG⁷, —S—G⁷ or

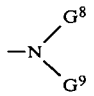

wherein $G^7$ represents a hydrogen atom, an alkyl group, a cycloalkyl group or an aryl group, $G^8$ has the same meaning as $G^7$ and additionally represents an acyl group, $G^9$ represents a hydrogen atom or a substituted or unsubstituted alkyl group, $\delta$ represents the atoms necessary for completing a fused benzene ring and $\gamma$ and/or the substituents on said fused benzene ring completed by $\delta$ is a ballast group or a ballast-containing group.

* * * * *